US009997345B2

(12) United States Patent
Hoyes et al.

(10) Patent No.: US 9,997,345 B2
(45) Date of Patent: Jun. 12, 2018

(54) ORTHOGONAL ACCELERATION COAXIAL CYLINDER MASS ANALYSER

(71) Applicant: MICROMASS UK LIMITED, Wilmslow (GB)

(72) Inventors: John Brian Hoyes, Stockport (GB); David J. Langridge, Macclesfield (GB); Jason Lee Wildgoose, Stockport (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days. days.

(21) Appl. No.: 15/301,179

(22) PCT Filed: Apr. 1, 2015

(86) PCT No.: PCT/GB2015/051022
§ 371 (c)(1),
(2) Date: Sep. 30, 2016

(87) PCT Pub. No.: WO2015/150808
PCT Pub. Date: Oct. 8, 2015

(65) Prior Publication Data

US 2017/0032951 A1 Feb. 2, 2017

(30) Foreign Application Priority Data

Apr. 1, 2014 (EP) ..... 14163006
Apr. 1, 2014 (GB) ..... 1405821.8

(51) Int. Cl.
*H01J 49/00* (2006.01)
*H01J 49/40* (2006.01)
(Continued)

(52) U.S. Cl.
CPC ..... *H01J 49/401* (2013.01); *H01J 49/0031* (2013.01); *H01J 49/025* (2013.01);
(Continued)

(58) Field of Classification Search
CPC ..... H01J 49/401; H01J 49/025; H01J 49/406; H01J 49/4245; H01J 49/0031; H01J 49/427
(Continued)

(56) References Cited

U.S. PATENT DOCUMENTS 6,744,042 B2 6/2004 Zajfman et al.
8,319,180 B2 11/2012 Nikolaev et al.
(Continued)

FOREIGN PATENT DOCUMENTS

GB 2390935 1/2004
GB 2505275 2/2014

OTHER PUBLICATIONS

Wiley et al., "*Time-of-Flight Mass Spectrometer with Improved Resolution*", Review of Scientific Instruments, vol. 26, pp. 1150, 1955.

*Primary Examiner* — Wyatt Stoffa
*Assistant Examiner* — Hanway Chang

(57) ABSTRACT

A mass analyzer is disclosed comprising an annular ion guide comprising a first annular ion guide section and a second annular ion guide section, wherein the annular ion guide comprises: (i) an inner cylindrical electrode arrangement which is axially segmented and comprises a plurality of first electrodes and (ii) an outer cylindrical electrode arrangement which is axially segmented and comprises a plurality of second electrodes. Ions are introduced into the first annular ion guide section so that the ions form substantially stable circular orbits. Ions are orthogonally accelerated from the first annular ion guide section into the second annular ion guide section and one or more parabolic DC potentials are maintained along a portion of the second annular ion guide section so that ions undergo simple harmonic motion. An inductive ion detector is arranged and
(Continued)

adapted to detect ions within the second annular ion guide section.

20 Claims, 28 Drawing Sheets

(51) Int. Cl.
*H01J 49/42* (2006.01)
*H01J 49/02* (2006.01)

(52) U.S. Cl.
CPC ..... *H01J 49/406* (2013.01); *H01J 49/427* (2013.01); *H01J 49/4245* (2013.01)

(58) Field of Classification Search
USPC ..... 250/281, 282, 286, 288, 290
See application file for complete search history.

(56) References Cited

U.S. PATENT DOCUMENTS

| | | | | |
|---|---|---|---|---|
| 8,853,623 | B2 | 10/2014 | Verenchikov | |
| 9,082,604 | B2 | 7/2015 | Verenchikov | |
| 9,159,544 | B2 | 10/2015 | Ding et al. | |
| 2004/0119012 | A1 | 6/2004 | Vestal | |
| 2005/0242279 | A1 | 11/2005 | Verentchikov | |
| 2005/0285030 | A1 | 12/2005 | Farnsworth | |
| 2009/0078866 | A1 | 3/2009 | Li et al. | |
| 2012/0138785 | A1 | 6/2012 | Makarov et al. | |
| 2012/0153140 | A1 | 6/2012 | Makarov | |
| 2013/0068942 | A1* | 3/2013 | Verenchikov ..... | H01J 49/4245 250/282 |
| 2013/0313425 | A1 | 11/2013 | Verenchikov | |
| 2014/0284471 | A1 | 9/2014 | Brown et al. | |
| 2014/0291503 | A1 | 10/2014 | Shchepunov et al. | |
| 2015/0136970 | A1 | 5/2015 | Hoyes et al. | |
| 2015/0170897 | A1 | 6/2015 | Hoyes et al. | |

* cited by examiner

Simion - 13.2k res

Analytic - 14k res

ORTHOGONAL ACCELERATION COAXIAL CYLINDER MASS ANALYSER

CROSS REFERENCE TO RELATED APPLICATION APPLICATIONS

This application is the National Stage of International Application No. PCT/GB2015/051022, filed 1 Apr. 2015 which claims priority from and the benefit of United Kingdom patent application No. 1405821.8 filed on 1 Apr. 2014 and European patent application No. 14163006.1 filed on 1 Apr. 2014. The entire contents of these applications are incorporated herein by reference.

FIELD OF THE INVENTION

The present invention relates generally to mass spectrometers and in particular to mass analysers, mass spectrometers, methods of mass analysing ions and methods of mass spectrometry.

BACKGROUND

Reference is made to W. C. Wiley, I. H. McLaren, "Time-of-Flight Mass Spectrometer with Improved Resolution" Review of Scientific Instruments 26, 1150 (1955) which sets out the basic equations that describe two stage extraction Time-of-Flight mass spectrometers. The principles apply equally to continuous axial extraction Time of Flight mass analysers, orthogonal acceleration Time of Flight mass analysers and time lag focussing instruments.

FIG. 1 shows the principle of spatial (or space) focussing whereby ions with an initial spatial distribution are brought to a focus at the plane of a detector so improving instrumental resolution.

The ion velocity and positional distributions are represented as phase space ellipses as shown in FIG. 2 which describe the condition of the ion beam as it traverses the instrument. A knowledge of the nature of phase space and Liouville's theorem is helpful to the understanding of various aspects of an embodiment.

A fundamental theorem in ion optics is Liouville's theorem which states that "For a cloud of moving particles, the particle density $\rho(x, p_x, y, p_y, z, p_z)$ in phase space is invariable.", wherein $p_x$, $p_y$, & $p_z$ are the momenta of the three Cartesian coordinate directions. Reference is made to "Geometrical Charged-Particle Optics", Harald H. Rose, Springer Series in Optical Sciences 142.

According to Liouville's theorem, a cloud of particles at a time $t_1$ that fills a certain volume in phase space may change its shape at a later time $t_n$ but not the magnitude of its volume. Attempts to reduce this volume by the use of electromagnetic fields is futile although it is of course possible to sample desired regions of phase space by aperturing the beam (rejecting un-focusable ions) before subsequent manipulation. A first order approximation splits Liouville's theorem into the three independent space coordinates x, y and z. The ion beam can now be described in terms of three independent phase space areas the shape of which change as the ion beam progresses through an ion optical system but not the total area itself. This concept is illustrated in FIG. 3 which shows an optical system comprising N optical elements with each element changing the shape of the phase space but not its area.

Ion distributions emanating from radio frequency ion guides containing buffer gases can typically be described in phase space distributions that are elliptical in shape. Such RF guides are commonly used to interface continuous ion beam sources such as Electrospray ionisation to Time of Flight mass analyser mass spectrometers. So it is the goal of the Time of Flight mass analyser designer to utilise the concept of spatial focussing to manipulate the initial ion beam represented by a phase space ellipse with large spatial distribution into one with a small distribution at the plane of the detector. Small spatial distributions at the detector plane coupled with long flight times make for high resolution Time of Flight mass analyser spectrometers. It is desired that the detector plane be isochronous for any particular mass to charge ratio. Generally Time of Flight mass analyser instruments disperse in mass to charge ratio according to the square of the time of flight (i.e. square root of mass to charge ratio is proportional to time). However, it is true that any ion (regardless of mass to charge ratio) when accelerated through any general electrostatic system of optical elements will take the same trajectory. So that an orthogonal acceleration Time of Flight mass analyser which may be considered to consist substantially of electrostatic elements, will bring ions of different mass to charge ratios into spatial focus at the same positions in the spectrometer but at different times.

The isochronous plane may be defined as being a plane in the spectrometer where ions of a unique mass to charge ratio have the same time of flight which is substantially independent of their initial phase space distribution, and it is at such a plane where an ion detector is sited for highest resolution. There are secondary effects which must be considered that make the Time of Flight mass analyser deviate from the ideal mass to charge ratio independent electrostatic system such as the finite rise time of the pusher, mass dependent phase space characteristics of ions emanating from RF devices, and the relative timing of pulsed ion packets and pulsed electric fields. These effects and the deviations from the ideal electrostatic system will be explained and discussed as they become relevant to various embodiments.

The angle of inclination of the ellipse represents a correlated position/velocity distribution. An ellipse which has a large spatial extent and gentle inclination may be created by ion beams emanating from RF guides that have been accelerated through transfer optics into the pusher (acceleration) region of an orthogonal Time of Flight mass analyser. Where the ellipse is of a vertical orientation (tall and thin) we have an isochronous plane where it may be possible to site an ion detector. The shape of the ellipses at different positions in the spectrometer as the ion beam traverses the instrument are presented in the following diagrams describing the invention. It should be understood that no scale is given to either the velocity or position axes of the ellipses and that they are for illustrative purposes to understand the principles underlying the operation of the invention only.

The simple two stage Wiley McLaren Time of Flight mass analyser as shown in FIG. 1 is created by defining three distinct regions bounded by four principal planes P1,P2,P3, P4. The different field regions are typically created by placing arrays of grid wires or meshes (known hereafter as grids) at the positions of the principal planes each of which has a potential (voltage) which may be static or pulsed in nature applied to it. Acceleration and deceleration regions are visualised by inclined planes or curves along which the ions can be considered to roll without friction. Note that this gravitational analogy is not completely correct in that ions experience forces in proportion to their charge in electrostatics and so ions of similar charge but different mass accelerate at rates inversely proportion to their mass (whereas in gravity the force is proportion to mass so all particles accelerate at the same rate regardless of mass).

Each time the ion beam passes through a grid ions are lost due to collisions with the grid wires and are also deflected by electric field variations that exist in close proximity to the boundary due to the different field strengths between the two adjacent regions (known as scattering). So as the beam traverses the spectrometer it gets weaker due to these losses and also defocusing (divergence) of the ion beam due to its initial velocity spread.

A voltage pulse Vp is applied to the pusher plate at P1 creating an orthogonal acceleration field extract a portion of the beam into the Time of Flight mass analyser. It is the timing of the application of this voltage pulse that serves as the start time for the Time of Flight mass analyser. All the ions of interest (different mass to charge ratios) are allowed to fly to the detector before the pusher can fire again. The duty cycle of the sampling of the incoming ion beam is typically around 20% to allow an undistorted beam to be extracted, and this figure falls off in inverse proportion to the square root of mass. It is advantageous to retain the initial (pre push) velocity of the ions so that the resulting flight path of the ions is at an angle to the flight tube created by a vector between the two velocities, i.e. that of the incoming beam and that imparted by the spectrometer fields. This resulting vectorial trajectory enables placement of the ion detector offset to the pusher region which is advantageous for simplicity of construction as will be explained more fully later on. Resolutions of around 5000 can be achieved for state of the art instruments employing this type of geometry for a flight length of up to one meter.

Higher resolutions can be achieved in orthogonal acceleration Time of Flight mass spectrometers by reflecting the ion beam back on itself using a reflectron. Such a device can be adjusted to give an isochronous plane in a field free region ("FFR") while maintaining a compact instrument geometry. With prudent adjustment of the voltages this process can be repeated multiple times to increase the effective flight length (and hence flight time of the ions) of the instrument while maintaining the existence of an isochronous plane in the field free region.

FIG. 4 shows an arrangement wherein ions are accelerated by a two stage acceleration region defined by planes P1,P2, P3 and enter a field free region (P3 to P4). The ions then traverse the reflectron defined by planes P4,P5,P6 before returning through the field free region to a small mirror defined by planes P3,P7. The ion beam is sent back to the main reflectron after which it is sent back through the field free region at the end of which is placed a detector at the position of the isochronous plane namely P3.

The vectorial trajectory whereby the beam retains its initial component of direction of motion enables the ion detector to be placed adjacent to the pusher region. Resolutions as high as 50,000 to 100,000 are achievable with such a geometry but this performance comes at a cost to sensitivity (ion transmission). In this case the ion beam passes through grids 12 times, attenuating the beam on each pass.

In addition to this loss the ion beam is diverging due its initial velocity spread and the scattering due to the fields in proximity to the grids, so its cross section has increased dramatically at the detector plane. When these factors along with the finite duty cycle of the instrument are all factored in, transmission may be as low as 1% of the initial beam intensity therefore reducing the sensitivity of the instrument.

WO 2005/040785 (Farnsworth) discloses a modified Spiratron arrangement wherein ions are introduced into the analyser using a pulsed electric field applied to a third sector electrode 155 as shown in FIG. 5 of WO 2005/040785 (Farnsworth). A packet of ions is sent into a pair of coaxial cylinders at an angle θ as shown in FIG. 6 of WO 2005/040785 (Farnsworth) where they undergo a helical trajectory 175 until they are ejected to an ion detector which is located external to the guide (as is apparent from FIG. 3 of WO 2005/040785 (Farnsworth) wherein the ion detector 70 is shown located outside of the flight tube). Ions attain stable trajectories by virtue of a pulsed voltage being applied to a third electrode. There is no disclosure of how to get ions out of the device once they are in the flight tube at the detector end.

It is noted that page 9, lines 9-10 of WO 2005/040785 (Farnsworth) implies a T/ΔT of 1000 (1 kHz repetition rate with 1 μs injection pulses) giving a maximum attainable resolution of 500. The low resolution is due to the fact that the disclosed arrangement imparts only first order energy (or spatial) focussing characteristic to the ion packet in the angular dimension.

It is also noted that page 9, lines 11-18 of WO 2005/040785 (Farnsworth) contemplates an arrangement using a continuous Electrospray ion source wherein an upstream trap 90 may not be provided. It is suggested that according to this arrangement ions may be injected at θ=0° and the application of a voltage pulse to impart an axial drift velocity to the ions is delayed. This arrangement is also described on page 15, lines 5-15 of WO 2005/040785 (Farnsworth).

It will be understood by those skilled in the art that if a beam of ions is injected into the arrangement disclosed in WO 2005/040785 (Farnsworth) at θ=0° then in the context of the modified Spiratron arrangement disclosed therein the ions would need to be restricted from making a full rotation before an axial field was applied. Importantly, ions injected into the annular region disclosed in WO 2005/040785 (Farnsworth) would assume different rotational positions dependent upon their mass to charge ratio. Accordingly, ions having a relatively low mass to charge ratio might make nearly one rotation by the time that the axial field was applied whereas ions having a relatively high mass to charge ratio would make only a fraction of one rotation by the time that the axial field is applied.

Allowing a delay between ion injection and orthogonal acceleration would therefore result in ions having a mass dependent starting position such that the resolution of the mass analyser would be reduced even further.

With reference to FIG. 3 of WO 2005/040785 (Farnsworth) it is apparent that a port is provided between the annular region and the ion detector 70 through which ions must pass in order to be detected by the ion detector. Since ions would have a starting position which is mass dependent at the time that the axial field is applied, then ions having different masses would follow different helical paths through the annular region. As a result, some ions will follow helical trajectories which would miss the extraction port and hence not be detected by the ion detector.

The modified Spiratron arrangement disclosed in WO 2005/040785 (Farnsworth) would therefore also have a severe mass range limitation.

GB-2390935 (Verentchikov) discloses an arrangement as shown in FIG. 14 of GB-2390935 which comprises two Time of Flight mass spectrometers. Parent ions are separated in a first slow (and long) time of flight mass spectrometer (TOF1) which operates at low ion energies (1 to 100 eV) and fragment ions are subsequently mass analysed in a second fast and short time of flight mass spectrometer (TOF2) operating at much higher keV energy. Ions are injected into the first time of flight mass spectrometer TOF1 at an angle of inclination relative to the axis of two electrodes so that ions follow helical paths. It will be understood by those skilled in the art that the ions are not orthogonally accelerated into an annular ion guiding region. It is also apparent that the resolution of the arrangement disclosed in FIG. 14 of GB-2390935 is very low (R~75).

US 2013/0068942 (Verenchikov) discloses in FIG. 19 a folded flight path Time of Flight mass analyser arrangement.

WO 2013/171501 (Micromass) and GB-2505275 (Micromass) disclose an orthogonal acceleration coaxial Time of Flight mass analyser having a destructive ion detector.

GB-2482785 (Nikolaev) discloses a Kingdon mass spectrometer with cylindrical electrodes.

It is desired to provide a high resolution, high transmission orthogonal acceleration mass analyser which is compact in size.

SUMMARY

According to an aspect there is provided a mass analyser comprising:

an annular ion guide having a longitudinal axis and comprising a first annular ion guide section and a second annular ion guide section, wherein the annular ion guide comprises: (i) an inner cylindrical electrode arrangement which is axially segmented and comprises a plurality of first electrodes; and (ii) an outer cylindrical electrode arrangement which is axially segmented and comprises a plurality of second electrodes;

a first device arranged and adapted to introduce ions into the first annular ion guide section so that the ions form substantially stable circular orbits within the first annular ion guide section about the longitudinal axis;

a second device arranged and adapted to orthogonally accelerate ions from the first annular ion guide section into the second annular ion guide section;

a device arranged and adapted to maintain one or more parabolic DC potentials along a portion of the second annular ion guide section so that ions undergo simple harmonic motion; and an inductive ion detector arranged and adapted to detect ions within the second annular ion guide section.

WO 2005/040785 (Farnsworth) does not disclose causing ions to form substantially stable circular orbits within an annular ion guide section about the longitudinal axis prior to being orthogonally accelerated.

The arrangements disclosed in WO 2005/040785 (Farnsworth) comprise modified Spiratron arrangements wherein ions follow helical orbits.

With reference to FIG. 3 of WO 2005/040785 (Farnsworth) it is apparent that the ion detector is not located within the annular ion guide and furthermore the ion detector comprises a destructive ion detector rather than an inductive ion detector. Furthermore, the detecting surface of the ion detector 70 is arranged in a plane which is parallel to the longitudinal axis. It will therefore be appreciated that the modified Spiratron arrangement disclosed in WO 2005/040785 (Farnsworth) operates in a fundamentally different manner to the present embodiments.

In the arrangement disclosed in WO 2005/040785 (Farnsworth) ions are accelerated in the flight tube and experience time of flight dispersion in a helical direction i.e. time of flight dispersion is in both a longitudinal and a rotational direction.

In contrast, according to the present embodiments time of flight dispersion occurs only in a longitudinal direction.

Ions which are orthogonally accelerated are arranged to be spatially focused to an isochronous plane which is substantially perpendicular to the longitudinal axis.

This is in contrast to the modified Spiratron arrangement disclosed in WO 2005/040785 (Farnsworth) wherein the isochronous plane is parallel to the longitudinal axis.

US 2013/0068942 (Verenchikov) discloses in FIG. 19 a folded flight path Time of Flight mass analyser arrangement. US 2013/0068942 (Verenchikov) does not teach or suggest maintaining one or more parabolic DC potentials along a portion of an annular ion guide section so that ions undergo simple harmonic motion.

The ion detector according to an embodiment may be arranged and adapted to detect ions within the second annular ion guide section in a non-destructive manner.

The ion detector may further comprise one or more first pick-up electrodes.

The one or more first pick-up electrodes may comprise one or more cylindrical, ring or annular electrodes.

The one or more first pick-up electrodes may be arranged along an outer section of the second annular ion guide section.

The one or more first pick-up electrodes may be connected to an amplifier or a differential amplifier which is arranged and adapted to amplify a signal induced in the one or more first pick-up electrodes.

The one or more first pick-up electrodes may be arranged substantially centrally within the second annular ion guide section.

The one or more first pick-up electrodes may alternatively be offset or displaced from the centre of the second annular ion guide section.

The second annular ion guide section may further comprise one or more second pick-up electrodes.

The one or more second pick-up electrodes may comprise one or more cylindrical, ring or annular electrodes.

The one or more second pick-up electrodes may be arranged along an inner section of the second annular ion guide section.

The one or more second pick-up electrodes may be connected to an amplifier or a differential amplifier which is arranged and adapted to amplify a signal induced in the ion detector.

The one or more second pick-up electrodes may be arranged substantially centrally within the second annular ion guide section.

The one or more second pick-up electrodes may be offset or displaced from the centre of the second annular ion guide section.

According to an embodiment ions are caused to oscillate within the second annular ion guide section and wherein the ion detector is arranged to detect a series of pulses, wherein each pulse is associated with a pass of ions through the second annular ion guide section.

The ion detector may be arranged to detect an induced signal wherein the induced signal may increases in intensity as an ion beam moves towards the ion detector and may decreases in intensity as the ion beam moves away from the ion detector.

The second device may be arranged and adapted to apply a pulsed axial electric field.

The second device may be arranged and adapted to apply a pulsed radial electric field at substantially the same time as the pulsed axial electric field. The second device may be arranged and adapted to apply a pulsed radial electric field at substantially the same time as the pulsed axial electric field so that the ions assume non-circular or elliptical orbits in a plane perpendicular to the longitudinal axis.

WO 2005/040785 (Farnsworth) does not teach or suggest applying a pulsed radial electric field at the same time as applying a pulsed axial electric field so that looking down the length of the annular ion guiding region ions assume elliptical rather than circular paths.

The second device may be arranged and adapted to orthogonally accelerate the ions into the second annular ion guide section so that the ions temporally separate according to their mass to charge ratio.

The second device is arranged and adapted to orthogonally accelerate the ions so that time of flight dispersion occurs only in a longitudinal direction.

Time of flight dispersion solely in a longitudinal direction represents a significant distinction of the present invention over known Spiratron arrangements such as the arrangement disclosed in WO 2005/040785 (Farnsworth) wherein time of flight dispersion is in a helical direction.

Furthermore, the isochronous plane of ions according to the various embodiments is substantially perpendicular to the isochronous plane of ions in the arrangements disclosed in WO 2005/040785 (Farnsworth).

According to an embodiment the ion detector is arranged and adapted to detect ions as the ions undergo multiple axial passes through the annular ion guide or the second annular ion guide section.

Such an arrangement is not disclosed in WO 2005/040785 (Farnsworth).

The ion detector may be arranged and adapted to detect ions as the ions pass through the annular ion guide or the second annular ion guide section one or more times in a first axial direction and pass through the annular ion guide or the second annular ion guide section one or more times in a second axial direction which is opposed to the first axial direction.

Such an arrangement is not disclosed in WO 2005/040785 (Farnsworth).

Embodiments are contemplated wherein the ion detector is located either: (i) substantially in the centre of the annular ion guide or the second annular ion guide section; (ii) substantially at an end of the annular ion guide or the second annular ion guide section; (iii) at an end of a field free region; (iv) adjacent the first annular ion guide section; or (v) distal to the first annular ion guide section.

The annular ion guide may comprise an inner cylindrical electrode arrangement.

The inner cylindrical electrode arrangement may be axially segmented and may comprise a plurality of first electrodes.

The annular ion guide may comprise an outer cylindrical electrode arrangement.

The outer cylindrical electrode arrangement may be axially segmented and may comprise a plurality of second electrodes.

According to an embodiment an annular time of flight ion guiding region is formed between the inner cylindrical electrode arrangement and the outer cylindrical electrode arrangement.

The mass analyser may further comprise a device arranged and adapted to apply DC potentials to the inner cylindrical electrode arrangement and/or the outer cylindrical electrode arrangement in order to maintain a radial DC potential which acts to confine ions radially within the annular ion guide.

The mass analyser may further comprise a control system arranged and adapted:

(i) to apply one or more first voltages to one or more of the first electrodes and/or the second electrodes so that ions located in the first annular ion guide section precess or move in orbits about the inner cylindrical electrode arrangement; and then (ii) to apply one or more second voltages to one or more of the first electrodes and/or the second electrodes so that ions are orthogonally accelerated into the second annular ion guide section so that ions pass along spiral paths through the second annular ion guide section in a first axial direction;

(iii) to apply one or more third voltages to one or more of the first electrodes and/or the second electrodes so that ions are reflected back in a second axial direction which is opposed to the first axial direction and wherein may the ions are caused to oscillate axially; and (iv) to determine the mass to charge ratio of ions passing through or oscillating axially within the annular ion guide or the second annular ion guide section.

The second device may be arranged and adapted to apply a potential difference across the first annular ion guide section so that ions are orthogonally accelerated out of the first annular ion guide section and pass into the second annular ion guide section.

Ions may follow substantially spiral paths as they pass through the second annular ion guide section. The spiral paths may be non-helical along at least a portion of the annular ion guide or the second annular ion guide section such that the ratio of curvature to torsion of the spiral paths varies or is non-constant.

This is in contrast to the modified Spiratron arrangement disclosed in WO 2005/040785 (Farnsworth) wherein ions follow helical paths such that the ratio of curvature to torsion of the ion paths remains constant.

The mass analyser may further comprise a device arranged and adapted to maintain one or more half-parabolic or other DC potentials along a portion of the annular ion guide or the second annular ion guide section in order to reflect ions.

Such an arrangement is not disclosed in WO 2005/040785 (Farnsworth).

The mass analyser may further comprise a device arranged and adapted to maintain one or more parabolic DC potentials along a portion of the annular ion guide or the second annular ion guide section so that ions undergo simple harmonic motion.

Such an arrangement is not disclosed in WO 2005/040785 (Farnsworth).

The annular ion guide or the second annular ion guide section may comprise one or more reflectrons for reflecting ions in a reverse axial direction.

Such an arrangement is not disclosed in WO 2005/040785 (Farnsworth).

The second device may be arranged to orthogonally accelerate ions at a time $T_1$ and wherein the ions are detected by the ion detector at a subsequent time $T_2$ and wherein ions having a mass to charge ratio in the range about <100, about 100-200, about 200-300, about 300-400, about 400-500, about 500-600, about 600-700, about 700-800, about 800-900 or about 900-1000 are arranged to have a total time of flight $T_2-T_1$ through the annular ion guide or the second annular ion guide section selected from the group consisting of: (i) about <50 μs; (ii) about 50-100 μs; (iii) about 100-150 μs; (iv) about 150-200 μs; (v) about 200-250 μs; (vi) about 250-300 μs; (vii) about 300-350 μs; (viii) about 350-400 μs; (ix) about 400-450 μs; (x) about 450-500 μs; and (xi) about >500 μs.

Ions having different mass to charge ratios follow substantially different spiral paths through the annular ion guide or the second annular ion guide section.

This is in contrast to a Spiratron arrangement as disclosed, for example, in WO 2005/040785 (Farnsworth) wherein ions having different mass to charge ratios follow essentially the same helical path since the ions experience time of flight dispersion in the helical direction.

According to an embodiment electrodes in the first annular ion guide section are segmented so that at least a first electric field sector and a second electric field sector are formed in use.

The mass analyser may further comprise a control system arranged and adapted at a first time T1 to inject ions substantially tangentially into the first electric field sector whilst maintaining a substantially zero radial electric field in the first electric field sector so that the ions experience a substantially field free region whilst being injected into the first annular ion guide section.

The control system may be further arranged and adapted to maintain a radial electric field in the second electric field sector so that at a second later time T2 ions pass from the first electric field sector into the second electric field sector and become radially confined.

The control system may be further arranged and adapted at a third time T3, wherein T3>T1, to cause a radial electric field to be maintained in the first electric field sector so that as ions pass from the second electric field sector into the first electric field sector the ions continue to be radially confined and form substantially stable circular orbits within the first annular ion guide section.

The second device may be arranged and adapted to orthogonally accelerate ions from the first annular ion guide section into the second annular ion guide section at a fourth time T4, wherein T4>T3.

The mass analyser comprises a control system arranged and adapted to determine the mass to charge ratio of the ions orthogonally accelerated from the first annular ion guide section into the second annular ion guide section.

According to an aspect there is provided a mass spectrometer comprising a mass analyser as described above.

The mass analyser may comprise a Time of Flight mass analyser.

According to an embodiment ions may be confined within the annular ion guide and/or the second annular ion guide section by a quadro-logarithmic potential or potential distribution or by a hyper-logarithmic potential or potential distribution.

According to an aspect there is provided a method of mass analysing ions comprising:

providing an annular ion guide having a longitudinal axis and comprising a first annular ion guide section and a second annular ion guide section, wherein the annular ion guide comprises: (i) an inner cylindrical electrode arrangement which is axially segmented and comprises a plurality of first electrodes; and (ii) an outer cylindrical electrode arrangement which is axially segmented and comprises a plurality of second electrodes;

introducing ions into the first annular ion guide section so that the ions form substantially stable circular orbits within the first annular ion guide section about the longitudinal axis;

orthogonally accelerating ions from the first annular ion guide section into the second annular ion guide section;

maintaining one or more parabolic DC potentials along a portion of the second annular ion guide section so that ions undergo simple harmonic motion; and inductively detecting ions within the second annular ion guide section.

US 2013/0068942 (Verenchikov) discloses in FIG. 19 a folded flight path Time of Flight mass analyser arrangement. US 2013/0068942 (Verenchikov) does not teach or suggest maintaining one or more parabolic DC potentials along a portion of an annular ion guide section so that ions undergo simple harmonic motion.

According to another aspect there is provided a method of mass spectrometry comprising a method as disclosed above.

According to an arrangement there is provided a mass analyser, optionally a Time of Flight mass analyser, comprising:

an annular ion guide having a longitudinal axis and comprising a first annular ion guide section and a second annular ion guide section;

a first device arranged and adapted to introduce ions into the first annular ion guide section so that the ions form substantially stable circular orbits within the first annular ion guide section about the longitudinal axis;

a second device arranged and adapted to orthogonally accelerate ions from the first annular ion guide section into the second annular ion guide section; and an ion detector disposed within the annular ion guide and having an ion detecting surface arranged in a plane which is substantially perpendicular to the longitudinal axis.

According to an arrangement there is provided a method of mass analysing ions comprising:

providing an annular ion guide having a longitudinal axis and comprising a first annular ion guide section and a second annular ion guide section;

introducing ions into the first annular ion guide section so that the ions form substantially stable circular orbits within the first annular ion guide section about the longitudinal axis;

orthogonally accelerating ions from the first annular ion guide section into the second annular ion guide section; and detecting the ions using an ion detector disposed within the annular ion guide and having an ion detecting surface arranged in a plane which is substantially perpendicular to the longitudinal axis.

According to an aspect there is provided a mass analyser, optionally a Time of Flight mass analyser, comprising:

an annular ion guide having a longitudinal axis; and a device arranged and adapted to orthogonally accelerate ions into the annular ion guide such that the ions become temporally separated and wherein time of flight dispersion occurs only in a longitudinal direction.

Such an arrangement is not disclosed in WO 2005/040785 (Farnsworth).

According to the arrangement disclosed in WO 2005/040785 (Farnsworth) time of flight dispersion is in the helical direction i.e. the time of flight dispersion does not occur only or solely in the longitudinal direction.

According to an aspect there is provided a method of mass analysing ions comprising:

providing an annular ion guide having a longitudinal axis; and orthogonally accelerating ions into the annular ion guide such that the ions become temporally separated and wherein time of flight dispersion occurs only in a longitudinal direction.

Such an arrangement is not disclosed in WO 2005/040785 (Farnsworth). According to the arrangement disclosed in WO 2005/040785 (Farnsworth) time of flight dispersion is in the helical direction i.e. the time of flight dispersion does not occur only or solely in the longitudinal direction.

According to an aspect there is provided a mass analyser, optionally a Time of Flight mass analyser, comprising:

an annular ion guide having a longitudinal axis; and a device arranged and adapted to orthogonally accelerate ions into the annular ion guide wherein the ions are spatially focused to an isochronous plane which is substantially perpendicular to the longitudinal axis.

This is in contrast to the arrangement disclosed in WO 2005/040785 (Farnsworth) wherein the isochronous plane is parallel to the longitudinal axis.

According to an aspect there is provided a method of mass analysing ions comprising:

providing an annular ion guide having a longitudinal axis; and orthogonally accelerating ions into the annular ion guide and spatially focusing the ions to an isochronous plane which is substantially perpendicular to the longitudinal axis.

This is in contrast to the arrangement disclosed in WO 2005/040785 (Farnsworth) wherein the isochronous plane is parallel to the longitudinal axis.

According to an aspect there is provided a mass analyser, optionally a Time of Flight mass analyser, comprising:

an annular ion guiding region; and a first device arranged and adapted to orthogonally accelerate ions into the annular ion guiding region.

A person skilled in the art will appreciate that with known Spiratron arrangements ions follow a helical path. In contrast to such known arrangements, the path taken by ions according to an embodiment is not substantially helical. It will be appreciated that a curve is called a general helix if and only if the ratio of curvature to torsion is constant. According to an embodiment ions do not make uniform rotations along the axial direction.

The mass analyser may further comprise a first cylindrical electrode arrangement.

The first cylindrical electrode arrangement may be axially segmented and may comprise a plurality of first electrodes.

The mass analyser may further comprise a second cylindrical electrode arrangement.

The second cylindrical electrode arrangement may be axially segmented and may comprise a plurality of second electrodes.

The annular ion guiding region may be formed between the first cylindrical electrode arrangement and the second cylindrical electrode arrangement.

In a first mode of operation ions may precess or move in orbits within a first portion of the annular ion guiding region.

The first device may be arranged and adapted to apply a potential difference across a first portion of the annular ion guiding region so that ions are orthogonally accelerated out of the first portion of the annular ion guiding region and pass into a second portion of the annular ion guiding region.

Ions may undergo one or more orbits and/or follow helical paths as they pass through the second portion of the annular ion guiding region.

The mass analyser may further comprise an ion detector.

The ion detector may be located within or adjacent the annular ion guiding region.

The ion detector may have an annular ion detecting surface.

The ion detector may be located in the centre of the annular ion guiding region.

The ion detector may be located at the end of a field free region and/or at an end of the annular ion guiding region.

The ion detector may be located adjacent the first portion of the annular ion guiding region.

The ion detector may be located distal to the first portion of the annular ion guiding region.

The mass analyser may further comprise a device arranged and adapted to maintain one or more half-parabolic or other potentials along a portion of the annular ion guiding region in order to reflect ions.

The mass analyser may further comprise a device arranged and adapted to maintain one or more parabolic potentials along a portion of the annular ion guiding region so that ions undergo simple harmonic motion.

The annular ion guiding region may comprise one or more reflectrons for reflecting ions in a reverse axial direction.

Ions may be orthogonally accelerated at a time T1 and are detected at a time T2 and wherein ions having a mass to charge ratio in the range about <100, about 100-200, about 200-300, about 300-400, about 400-500, about 500-600, about 600-700, about 700-800, about 800-900 or about 900-1000 are arranged to have a total time of flight T2-T1 through the annular ion guiding region selected from the group consisting of: (i) about <50 μs; (ii) about 50-100 μs; (iii) about 100-150 μs; (iv) about 150-200 μs; (v) about 200-250 μs; (vi) about 250-300 μs; (vii) about 300-350 μs; (viii) about 350-400 μs; (ix) about 400-450 μs; (x) about 450-500 μs; and (xi) about >500 μs.

According to an aspect there is provided a mass spectrometer comprising a mass analyser as described above.

According to an aspect there is provided a method of mass analysing ions comprising:

orthogonally accelerating ions into an annular ion guiding region; and determining the time of flight or mass to charge ratio of the ions.

According to an aspect there is provided a method of mass spectrometry comprising a method of mass analysing ions as described above.

According to an aspect there is provided a mass analyser, optionally a Time of Flight mass analyser, comprising:

an inner cylindrical electrode arrangement comprising a plurality of first electrodes and an outer cylindrical electrode arrangement comprising a plurality of second electrodes, wherein the outer cylindrical arrangement is arranged about the inner cylindrical electrode so as to form, in use, an annular ion guiding region between the inner and outer electrodes;

an ion detector disposed within or at an end of the annular ion guiding region, wherein the ion detector may comprises an inductive ion detector; and a control system arranged and adapted:

(i) to apply one or more first voltages to one or more of the first electrodes and/or the second electrodes so that ions are located in a first region of the annular ion guiding region, wherein ions precess or move in orbits about the inner cylindrical electrode arrangement; and then (ii) to apply one or more second voltages to one or more of the first electrodes and/or the second electrodes so that ions are orthogonally accelerated into a second region of the annular ion guiding region so that ions pass along helical or spiral paths through the second region of the annular ion guiding region in a first axial direction;

(iii) to apply one or more third voltages to one or more of the first electrodes and/or the second electrodes so that ions are reflected back in a second axial direction which is opposed to the first axial direction and wherein may the ions are caused to oscillate axially; and (iv) to determine the mass to charge ratio of ions passing through or oscillating axially within the annular ion guide or the second annular ion guide section.

According to an aspect there is provided a method of mass analysing ions comprising:

causing ions to be located in a first region of an annular ion guiding region, wherein ions precess or move in orbits about an inner cylindrical electrode arrangement; and then orthogonally accelerating ions into a second region of the annular ion guiding region so that ions pass along helical or spiral paths through the second region of the annular ion guiding region in a first axial direction;

reflecting ions back in a second axial direction which is opposed to the first axial direction and may causing the ions to oscillate axially; and determining the mass to charge ratio of ions passing through or oscillating within the annular ion guiding region.

A disadvantage of known orthogonal acceleration Time of Flight mass analysers is that they suffer from transmission loss due to divergence of the ion beam in long flight path instruments resulting in overfilling of the available detector area. The divergence may arise from initial ion beam conditions or from scattering at the grid boundaries.

An embodiment seeks to overcome this limitation by confining ions in a stable radial orbit which is perpendicular to the direction of time of flight dispersion.

An embodiment has a number of advantages over conventional arrangements. An embodiment, for example, has increased resolution over single pass devices.

According to an embodiment the mass analyser also has high transmission in multipass mode due to gridless construction of repeating flight path elements.

Another advantage of an embodiment is that it has high transmission due to stable radial confinement preventing overfilling of the detector (by divergence).

An embodiment also has a high duty cycle of ion packets injected into instrument.

Another advantage of an embodiment is that there is no use of external ion deflectors to align ions with the instrument optic axis. Such deflectors introduce aberrations and complexity of construction.

A further advantage of an embodiment is increased entrance energy and consequential tolerance to surface charging of upstream components.

According to an embodiment the process of Electron Transfer Dissociation fragmentation comprises interacting analyte ions with reagent ions, wherein the reagent ions comprise dicyanobenzene, 4-nitrotoluene or azulene reagent ions.

According to an aspect there is provided a mass analyser comprising:

an annular ion guide having a longitudinal axis and comprising a first annular ion guide section and a second annular ion guide section;

a first device arranged and adapted to introduce ions into the first annular ion guide section so that the ions form substantially stable circular orbits within the first annular ion guide section about the longitudinal axis;

a second device arranged and adapted to orthogonally accelerate ions from the first annular ion guide section into the second annular ion guide section; and an inductive ion detector arranged and adapted to detect ions within the second annular ion guide section.

According to an aspect there is provided a method of mass analysing ions comprising:

providing an annular ion guide having a longitudinal axis and comprising a first annular ion guide section and a second annular ion guide section;

introducing ions into the first annular ion guide section so that the ions form substantially stable circular orbits within the first annular ion guide section about the longitudinal axis;

orthogonally accelerating ions from the first annular ion guide section into the second annular ion guide section; and inductively detecting ions within the second annular ion guide section.

According to an aspect there is provided a method of mass analysing ions comprising:

causing ions to be located in a first region of an annular ion guiding region, wherein ions precess or move in orbits about an inner cylindrical electrode arrangement; and then orthogonally accelerating ions into a second region of the annular ion guiding region so that ions pass along helical or spiral paths through the second region of the annular ion guiding region in a first axial direction;

reflecting ions back in a second axial direction which is opposed to the first axial direction and may causing the ions to oscillate axially; and determining the mass to charge ratio of ions passing through or oscillating within the annular ion guiding region.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; and (xxvi) a Solvent Assisted Inlet Ionisation ("SAII") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) one or more energy analysers or electrostatic energy analysers; and/or (h) one or more ion detectors; and/or (i) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; and/or (j) a device or ion gate for pulsing ions; and/or (k) a device for converting a substantially continuous ion beam into a pulsed ion beam.

The mass spectrometer may further comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage may has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) about >500 V peak to peak.

The AC or RF voltage may have a frequency selected from the group consisting of: (i) about <100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) about >10.0 MHz.

The mass spectrometer may also comprise a chromatography or other separation device upstream of an ion source. According to an embodiment the chromatography separation device may comprise a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) about <0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) about >1000 mbar.

According to an embodiment analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i)

sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to an embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments will now be described, by way of example only, together with other arrangements given for illustrative purposes only and with reference to the accompanying drawings in which.

DETAILED DESCRIPTION

Aspects of an embodiment will first be described with reference to FIGS. 4-18. An embodiment includes the provision of an inductive ion detector system which will be described in more detail with reference to FIGS. 19 and 20.

Figure 5:
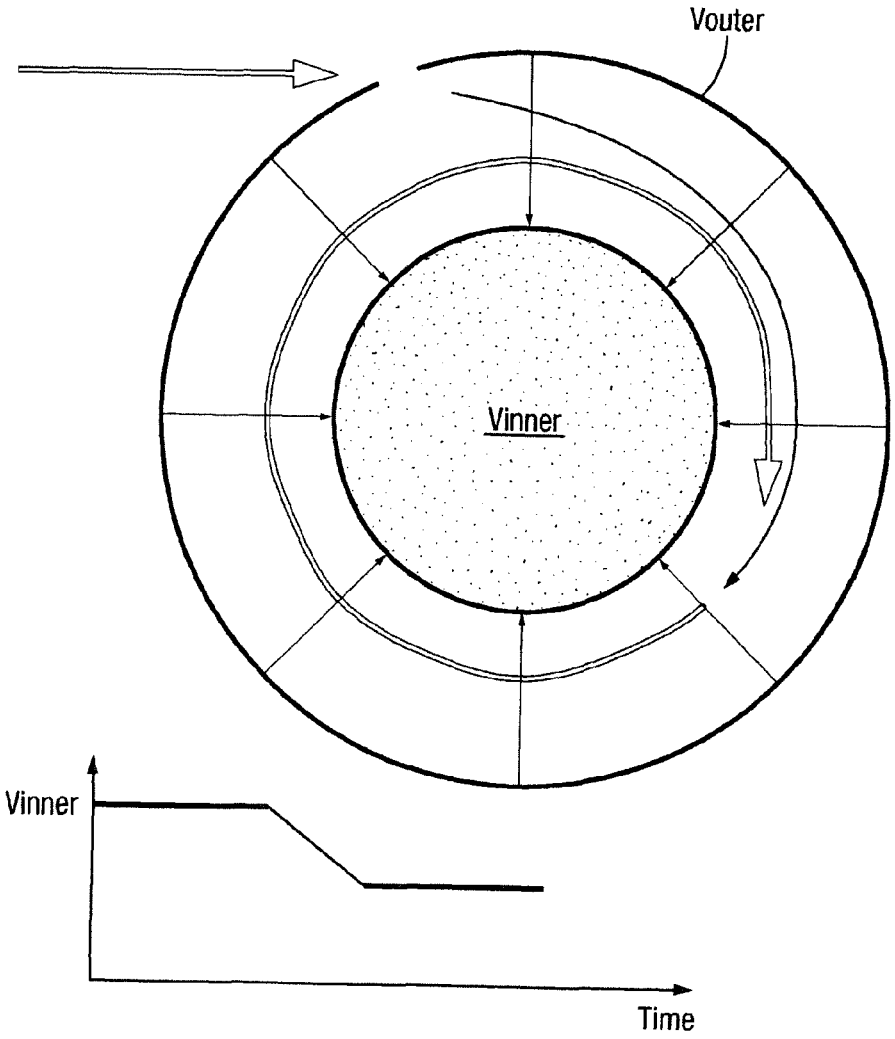
FIG. 5 shows an end view of a mass analyser according to an embodiment.

FIG. 5 illustrates an embodiment wherein a mass analyser is provided comprising two coaxial cylindrical electrodes with an annular ion guiding volume therebetween.

Ions are confined radially between two coaxial cylinders held at different potentials Vouter and Vinner. The ion beam (which may be a packet of ions containing the different mass to charge ratio species to be analysed) approaches the outer cylinder where either a hole or a gap through which the ion beam may pass may be provided.

Ions entering the annular ion guiding volume may form stable circular orbits by increasing the field between inner and outer cylinders as the beam is entering the device. In the absence of any other fields once inside the cylinders the ions may remain in orbit but will disperse in the axial direction according to their initial axial velocities. This is shown in FIG. 6A.

Figure 6A:
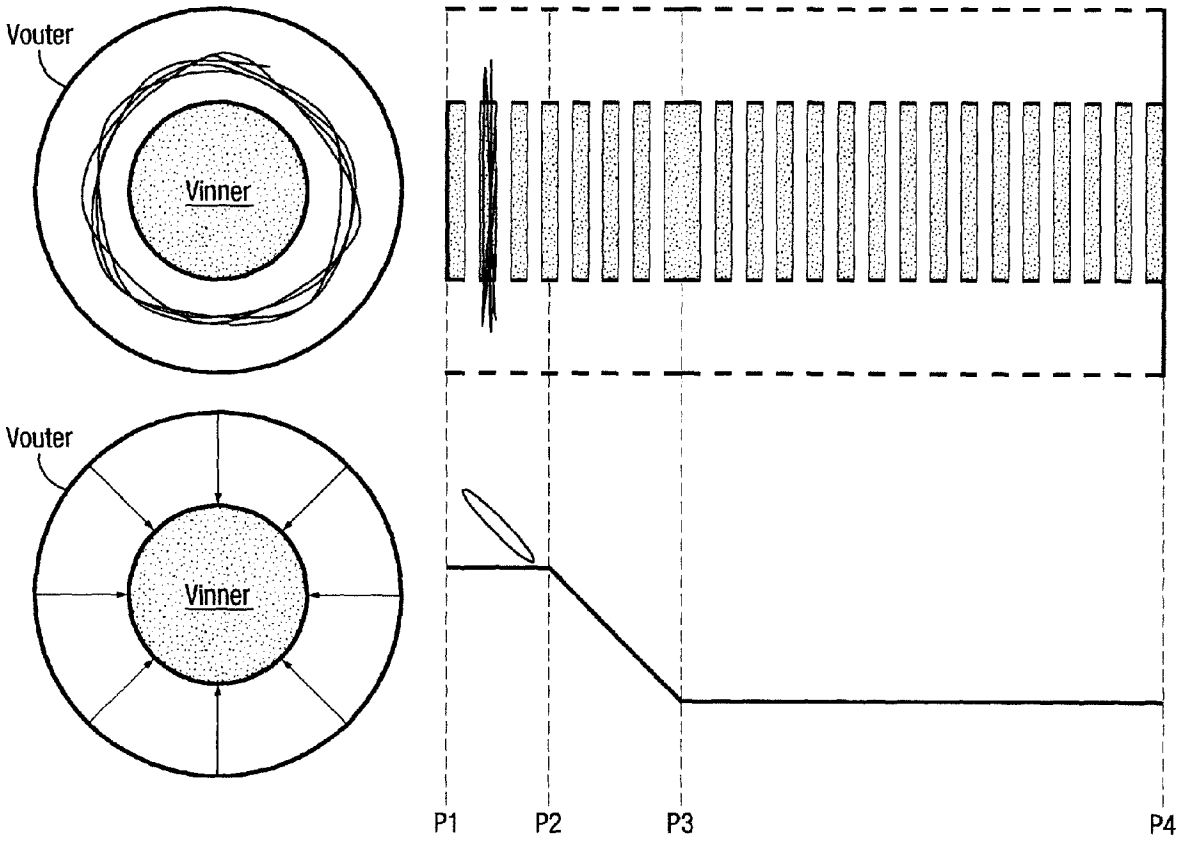
FIG. 6A shows ions confined in a stable orbit and FIG. 6B shows a pulsed voltage being applied to a grid which is placed inside the analyser between the two cylinders.
Figure 6B:
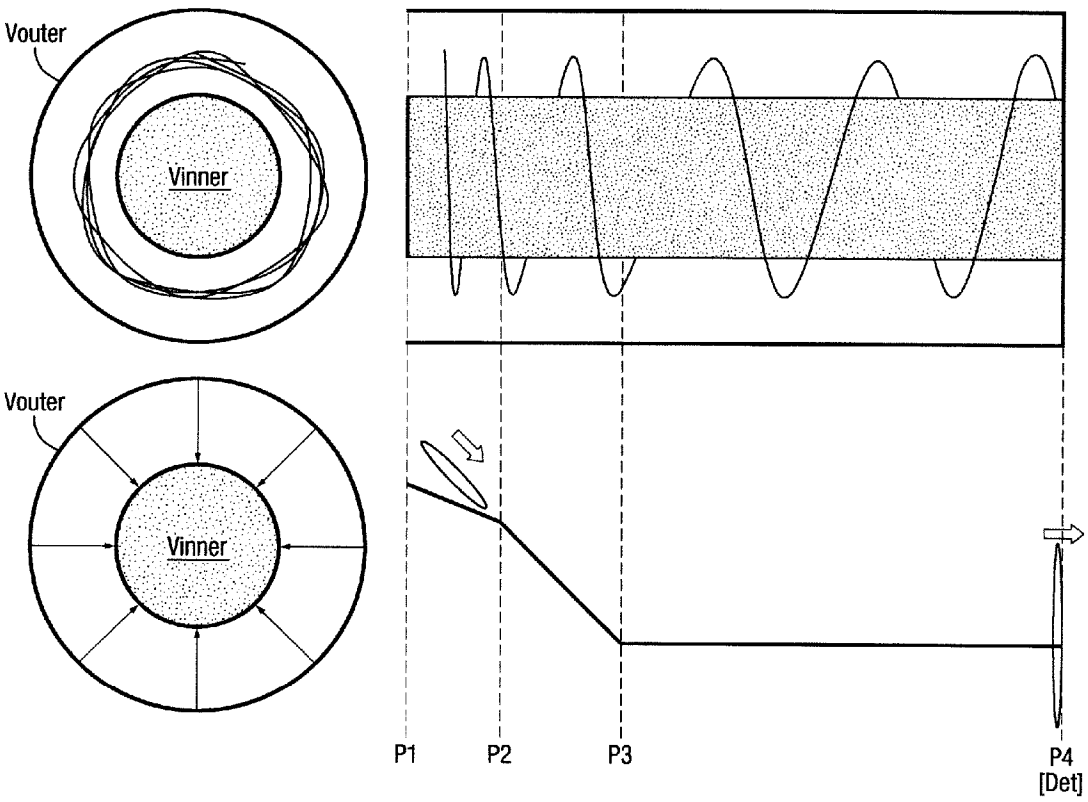

Referring now to FIG. 6B, once the ions are confined in stable orbit a pulsed voltage may be applied to a grid which may be placed inside the analyser between the two cylinders. In order to create the electric field functions required to achieve spatial focussing the inner and outer cylinders may be segmented and different voltages may be applied to each of the inner and outer segmented electrodes.

FIG. 6A shows how the inner and outer cylindrical electrodes may be axially segmented according to an embodiment. The inner and outer cylindrical electrodes may be axially segmented in all of the embodiments described below, although for ease of illustration only some of the following drawings may omit the axial segmentation.

Referring again to FIG. 6B, the ions may continue to rotate around the central electrode set but at the same time may begin to move along the axis of the mass analyser in a substantially helical manner.

It should be understood that time of flight dispersion only occurs in the axial direction and that the ions are confined radially to prevent transmission losses. As a result, the two coordinates in the preferred cylindrical device are decoupled in their behaviour.

Figure 1:
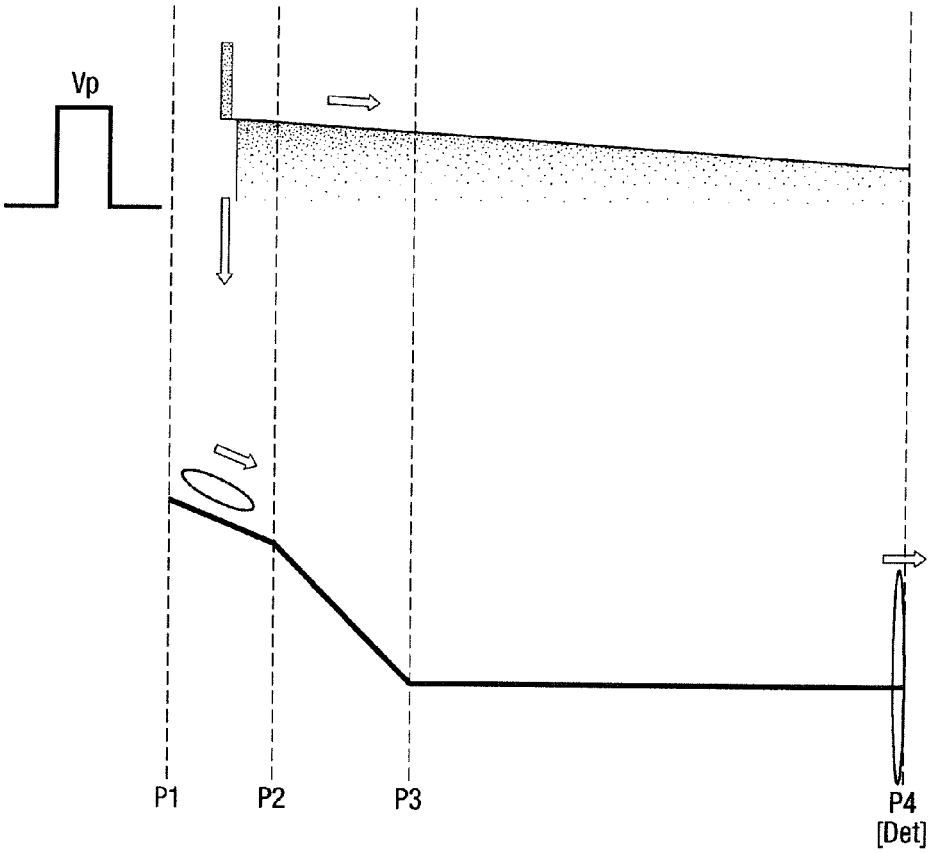
Fig. 1 Prior Art
FIG. 1 shows the principle of spatial focusing.
Figure 2:
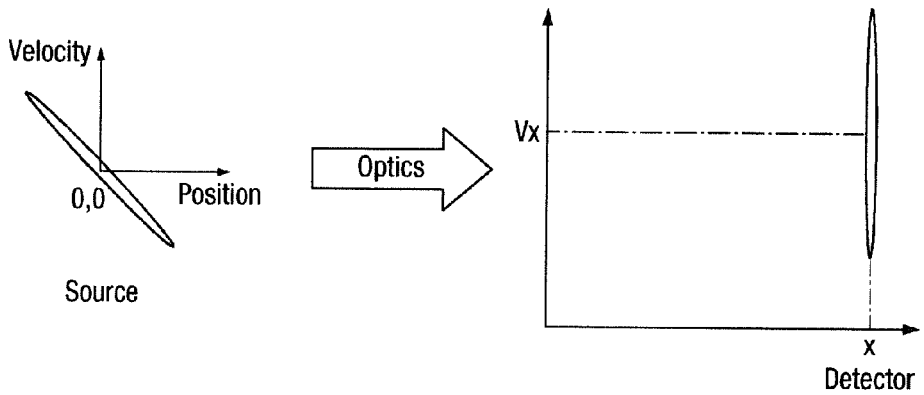
Fig. 2 Prior Art
FIG. 2 shows ion velocity and phase space ellipses.
Figure 3:
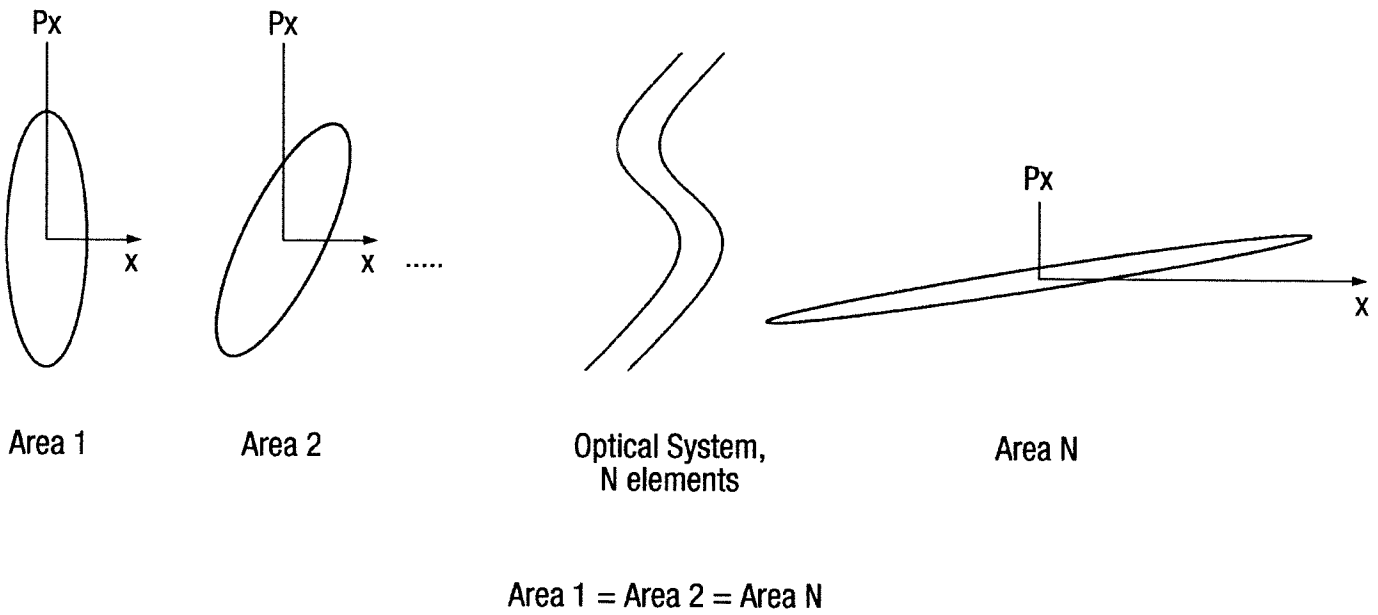
Fig. 3 Prior Art
FIG. 3 illustrates Liouville's theorem.
Figure 4:
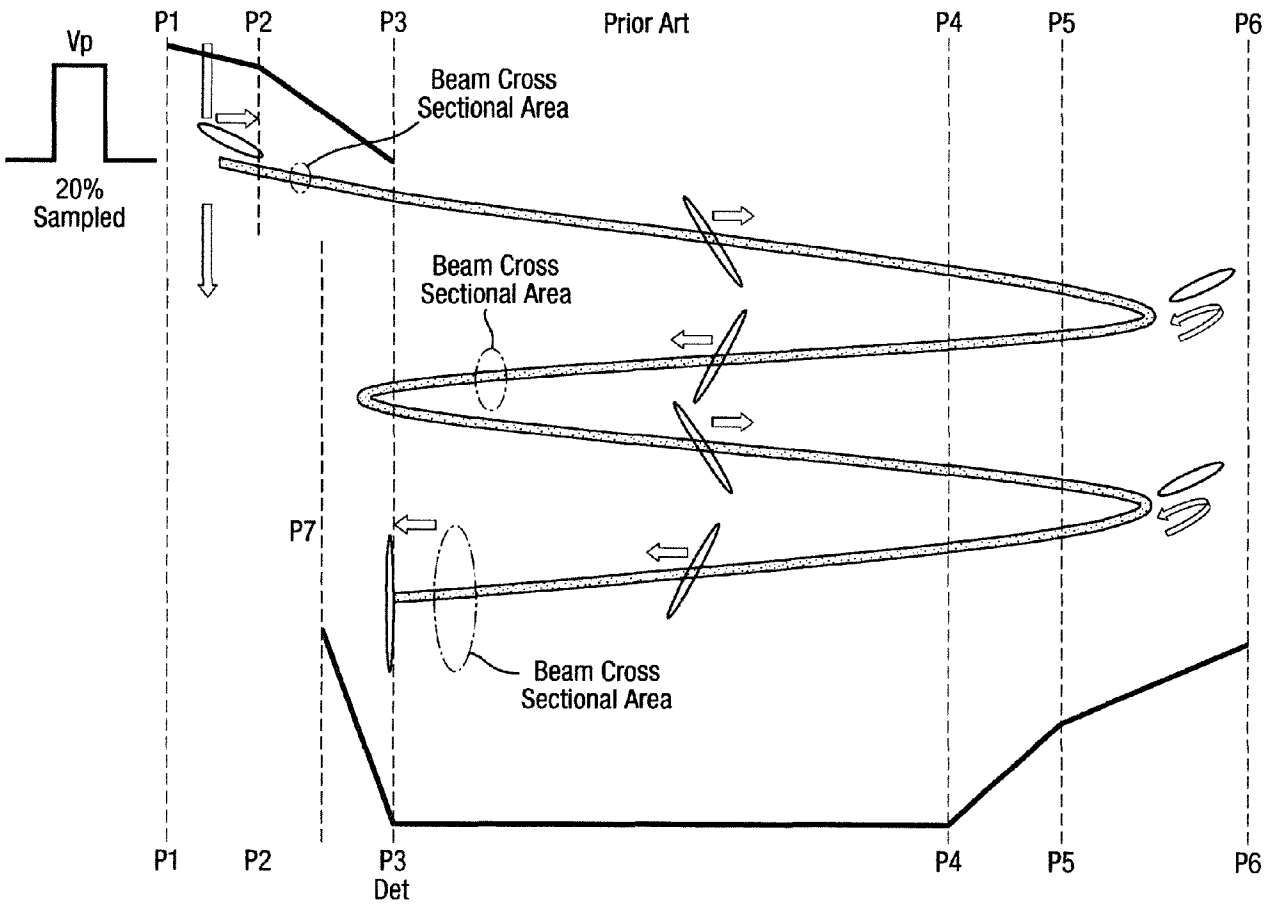
Fig. 4 Prior Art
FIG. 4 shows a W-shaped Time of Flight region in a conventional Time of Flight mass analyser.

FIG. 6B illustrates a simple embodiment with four principal planes P1,P2,P3,P4 which are directly analogous to the principal planes in a Wiley McLaren Time of Flight mass analyser as shown in FIG. 1. Spatial focussing is achieved in the same principle. However, in the geometry according to an embodiment as shown in FIG. 6B, the stable orbits in the radial direction prevent losses due to beam divergence and grid scattering at the grid boundaries.

A further advantage of the geometry according to an embodiment is that when coupled to a pulsed packet of ions incoming to the spectrometer the entire ion packet may be captured into a stable orbit and utilised. If ions are stored in an upstream RF device between spectrometer acquisition cycles (pushes) then essentially a 100% duty cycle is potentially achievable with the preferred geometry.

According to the embodiment shown in FIGS. 6A and 6B ions may still be lost due to collisions with grid electrodes but an embodiment advantageously has higher transmission than conventional arrangements.

Other embodiments are also contemplated and will be described below which do not utilise grid electrodes and which are therefore even more advantageous compared with conventional arrangements.

It should be noted that the application of an orthogonal acceleration electric field or pulsing electric field after stable radial orbits are achieved is an important distinction over other known forms of mass analysers.

In particular, electrostatic mass analysers are known wherein a packet of ions from outside the device is pulsed into the mass analyser using deflection devices to change the direction of the beam to the axis of the spectrometer. Such deflection devices cause aberrations in the time of flight and distortions in the isochronous plane. These aberrations limit the resolution of such devices such that very long flight times are required before high resolutions can be achieved.

A particular advantage of an embodiment is that the application of the acceleration field after stable orbits are achieved negates the need for deflection devices and enables resolution performances to be achieved in timescales similar to conventional orthogonal acceleration Time of Flight mass analysers.

It is an advantage of radially confined coaxial cylinder mass analysers according to embodiments that long flight paths are possible without losses due to beam divergence losses. As such an embodiment is ideally suited to multipass mass analyser geometries.

Various multipass geometries are contemplated and according to preferred embodiments contain the minimum number of grids to reduce losses at the principal planes.

Figure 7A:
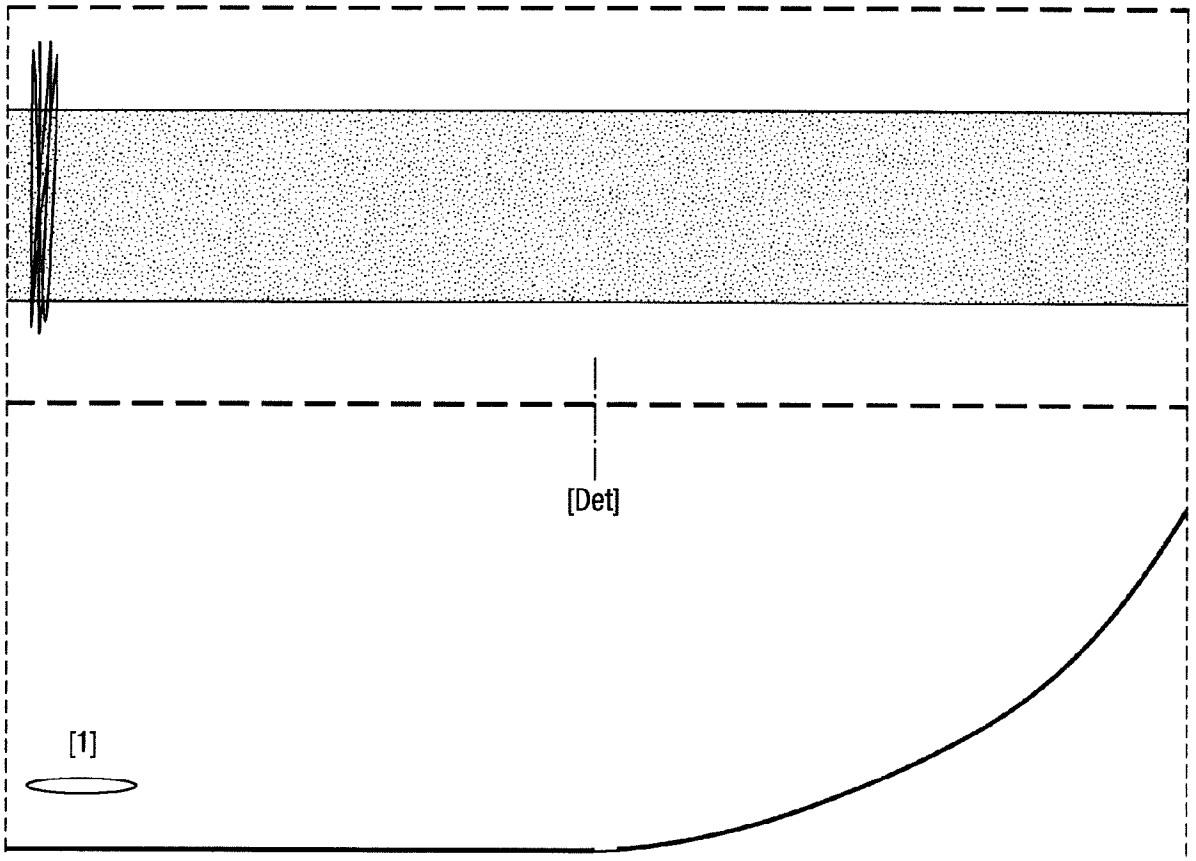
FIG. 7A shows an illustrative arrangement and FIG. 7B shows an embodiment.
Figure 7B:
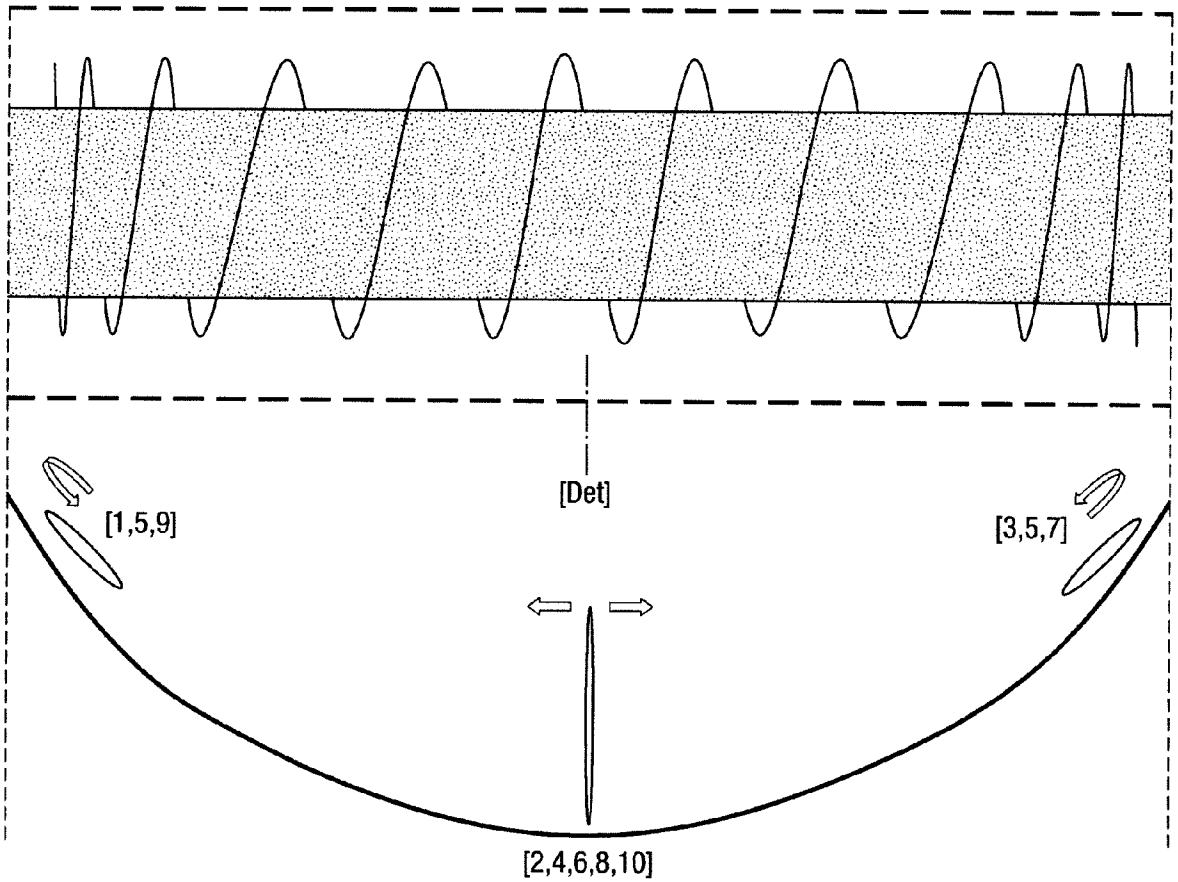

FIGS. 7A and 7B show an illustrative geometry. According to this embodiment ions are injected and stabilised into one side of an axially symmetric device before a parabolic potential is applied along the length of the mass analyser. The parabolic potential acts to accelerate the ions towards the centre of the spectrometer. The form of parabolic potential well may allows the ions to oscillate back and forth exhibiting simple harmonic motion. The more passes that the ions experience before detection the greater the resolution of the instrument. According to an embodiment ions are detected using an inductive ion detector.

Advantageously, ions may be stored in an upstream ion trap. Ions may be mass selectively ejected from the ion trap to sequentially release known mass ranges of ions to the analyser while storing others in the population. In this way a high resolution mass spectrum covering the entire mass range may stitched together from segments of the smaller acquired mass range.

The evolution of phase space illustrated in FIG. 7B shows that the isochronous plane is found in the centre of the device substantially at the bottom of the potential well. In fact there is a small deviation from the bottom which is a function of the inclination of the initial phase space ellipse but this is a small effect.

According to other less preferred embodiments the ion detector may be placed or located in a region of the instrument where there is no axial field present.

According to an embodiment the ion detector may be located in an axial field free region of the instrument as will now be discussed with reference to FIGS. 8A-8D. FIGS. 8A-8D show an embodiment incorporating a combination of a Wiley McLaren and parabolic potential well sections. Each of FIGS. 8A-8D illustrate a different time in the acquisition cycle of the instrument.

Figure 8A:
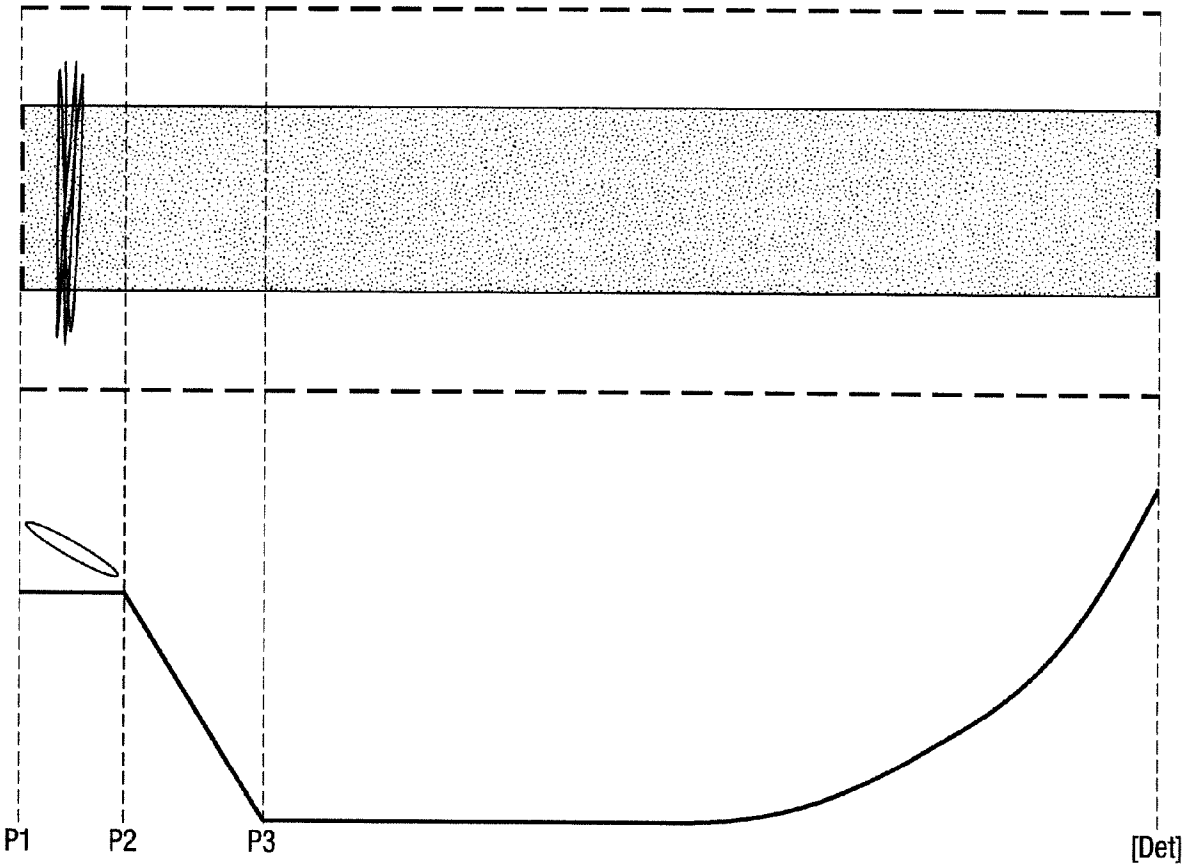
FIG. 8A shows an arrangement wherein ions are initially confined.

Ions may be extracted from a coaxial geometry mass analyser according to an embodiment and incorporating a two field Wiley McLaren type source. The ions are orthogonally accelerated into a field free region and pass along through the field free region. The ions then experience a parabolic potential gradient (half a well) as shown in FIGS. 8A and 8B.

Figure 8B:
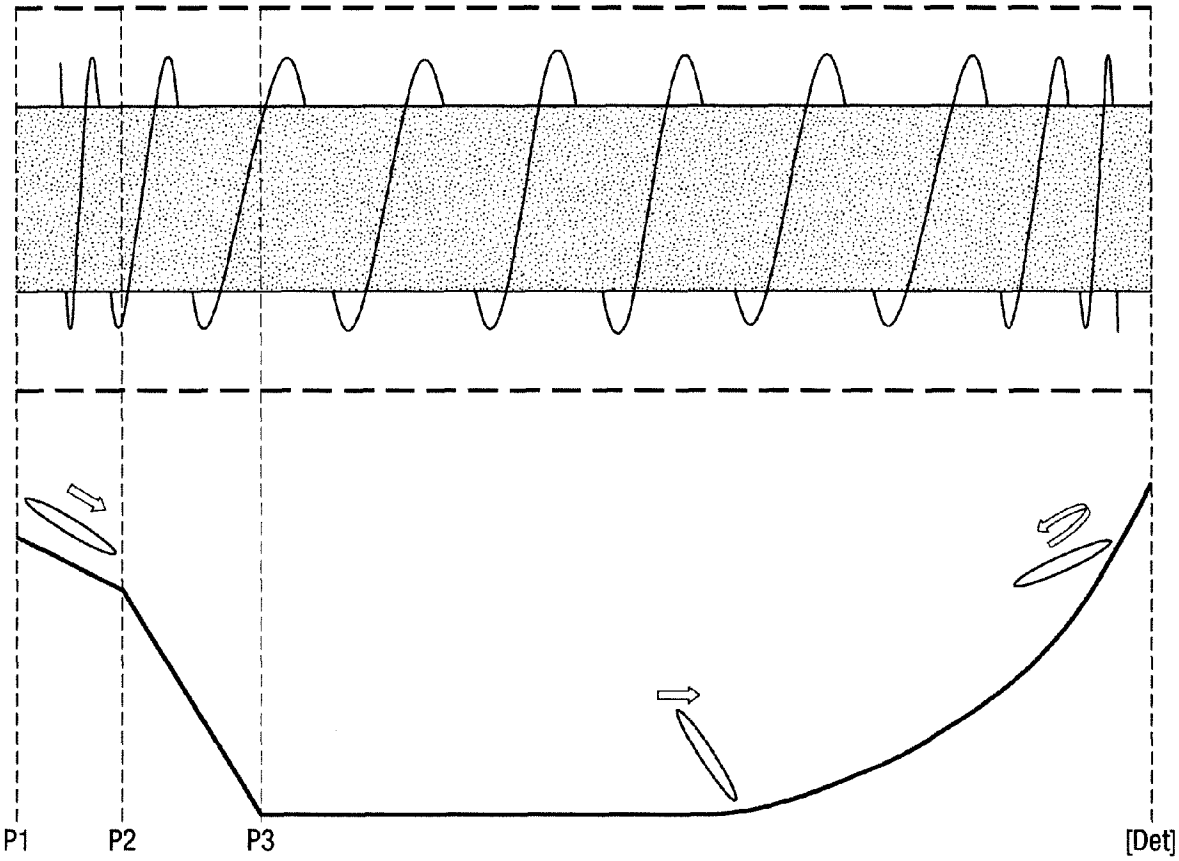
FIG. 8B shows a along a parabolic potential according to an embodiment and FIG. 8D shows an arrangement wherein the ions are transmitted to an ion detector.
Figure 8C:
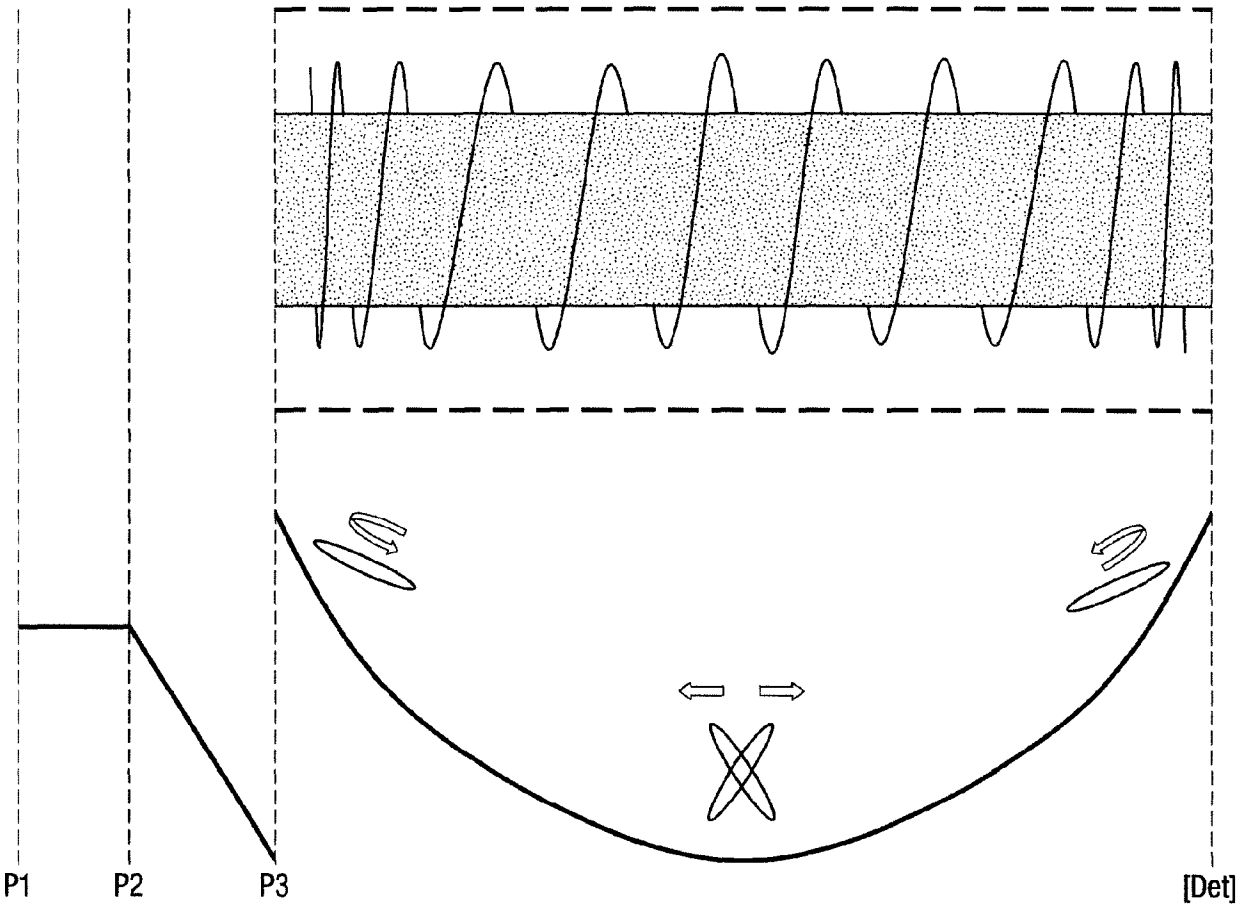
Figure 8D:
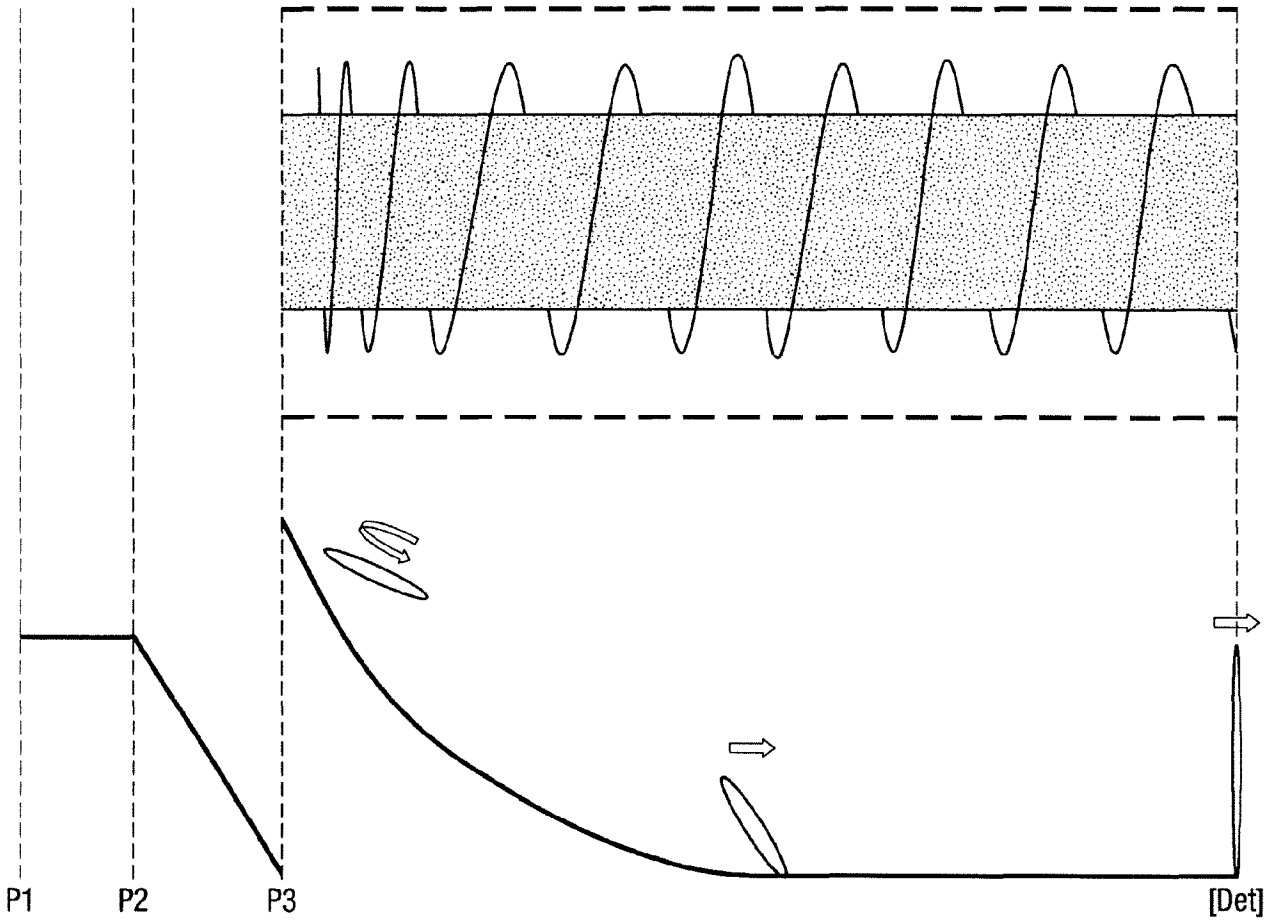

While ions are inside the parabolic section as shown in FIG. 8B, the other half of the well may be switched ON as shown in FIG. 8C and the ions may be allowed to oscillate for a desired number of times to increase the effective flight path of the instrument. According to an arrangement ions may be ejected towards an ion detector as shown in FIG. 8D. However, according to an embodiment ions are detected using an inductive ion detector.

It will be noted from FIG. 8D that the isochronous plane is no longer at the base of the potential well. This is due to the amount of field free region required to bring the ion beam into isochronous spatial focus being exactly the distance between P3 and the detector in this case. Only half of the field free region is taken up on its outward trip to the right hand half of the parabolic potential well. When this half is switched OFF the ions of interest fly the remaining required field free region to be brought into isochronous spatial focus. It is the combination of a geometry that allows a portion of field free region along with a parabolic potential well allowing simple harmonic motion that makes such a multipass instrument possible. Without such a field free region there would be nowhere to position the detector without distortion of the electric fields.

If a higher degree of spatial focussing is required then the pulsed parabolic potential well may be contained in a field free region of a reflectron mass analyser. This further embodiment will now be described with reference to FIGS. 9A-9F.

Figure 9A:
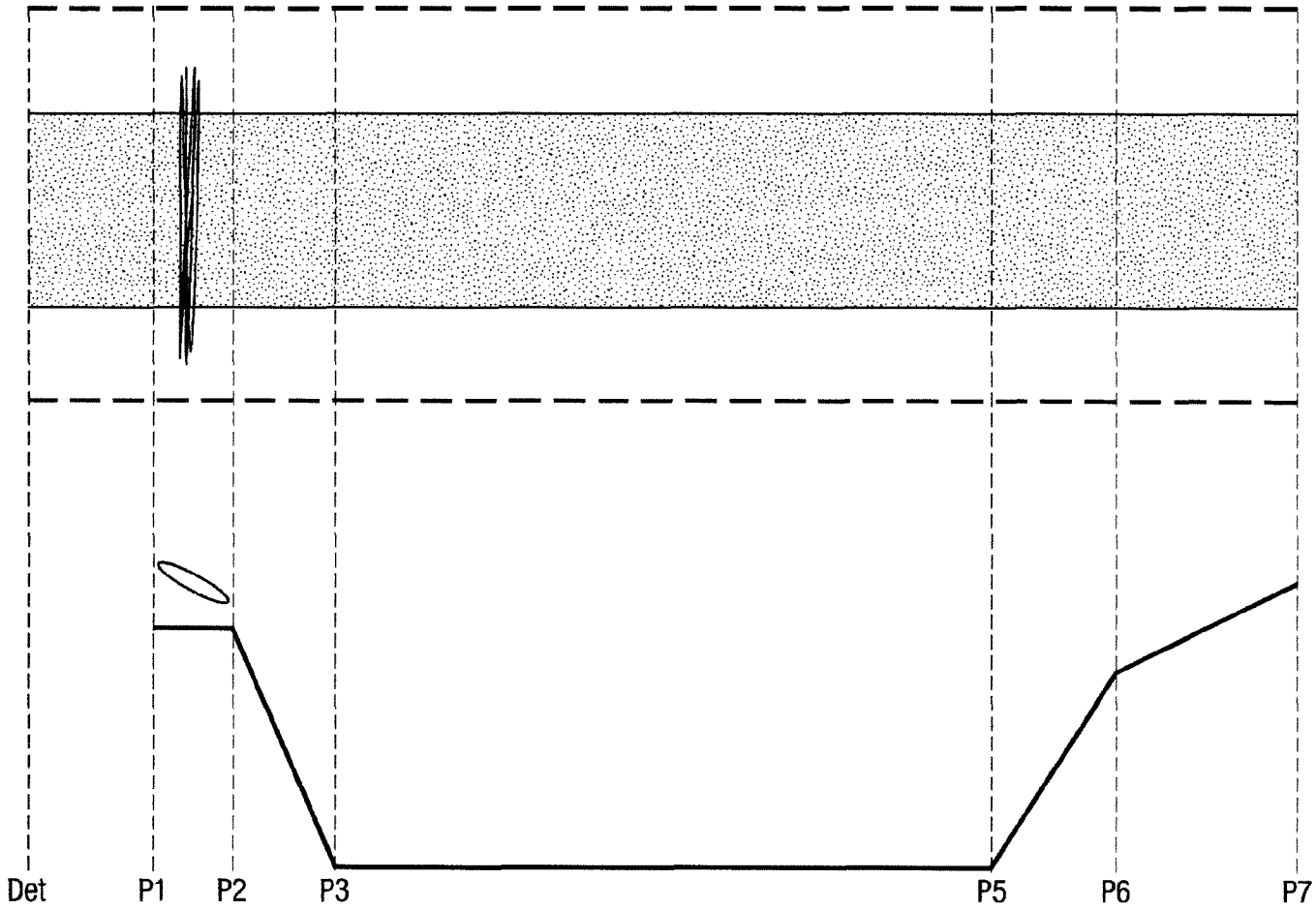
FIG. 9A shows ions being confined initially.
Figure 9B:
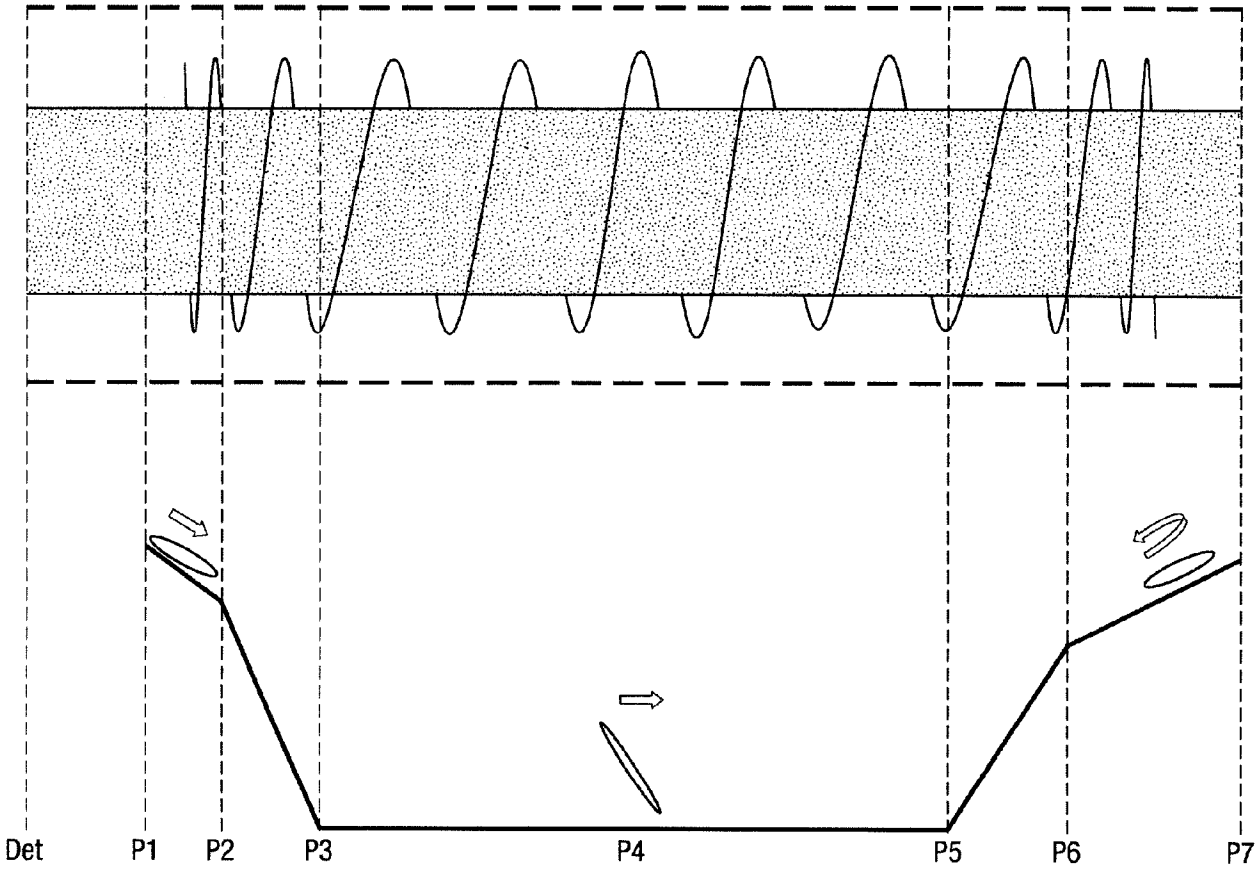
FIG. 9B shows ions being orthogonally accelerated.
Figure 9C:
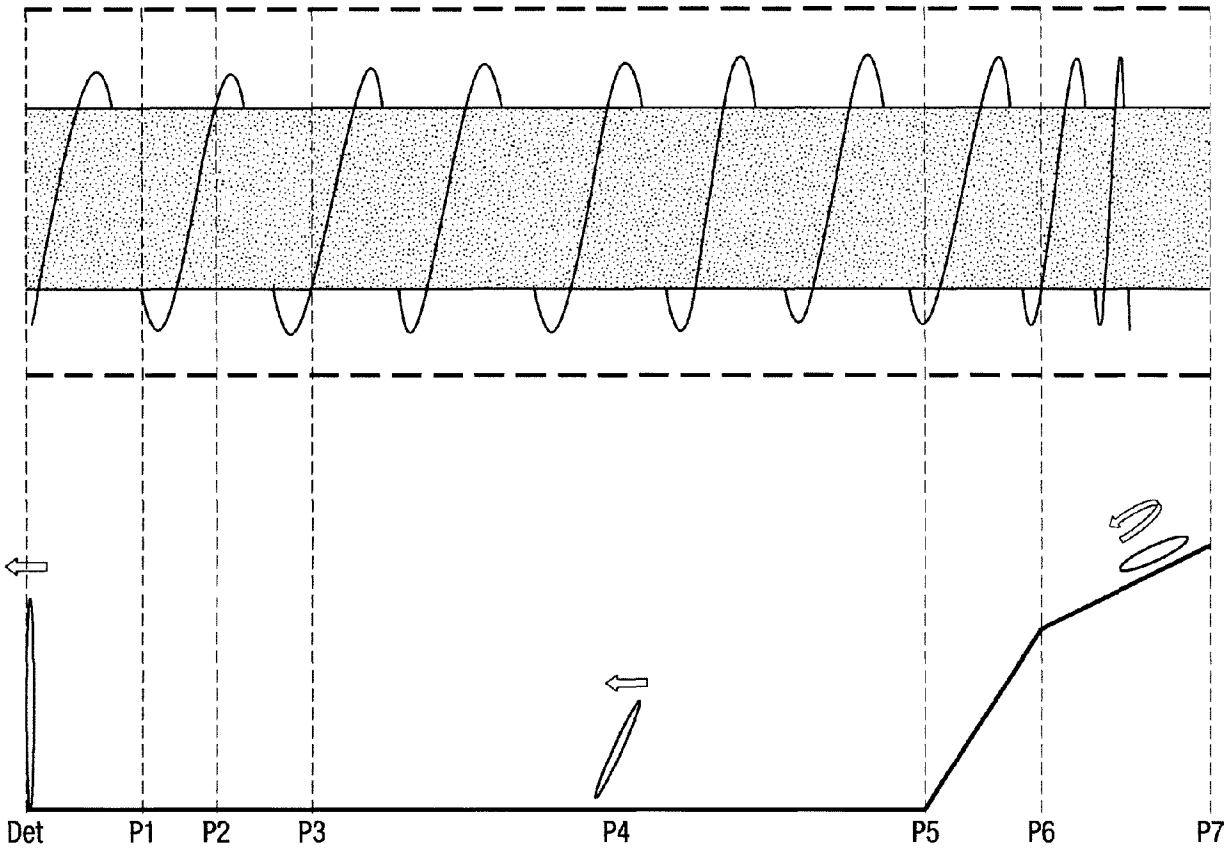
FIG. 9C shows ions being detected by an ion detector located at the exit of a field free region.
Figure 9D:
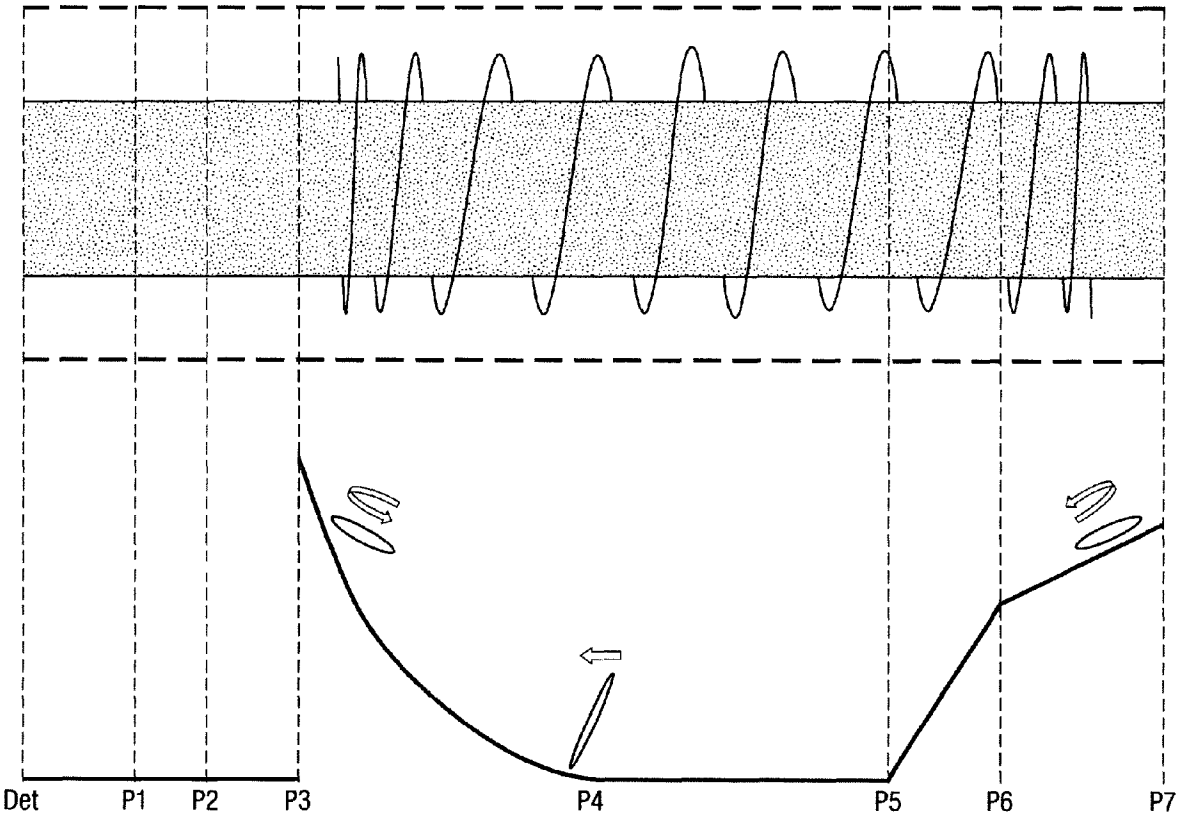
FIG. 9D shows an embodiment wherein ions experience a parabolic potential.
Figure 9E:
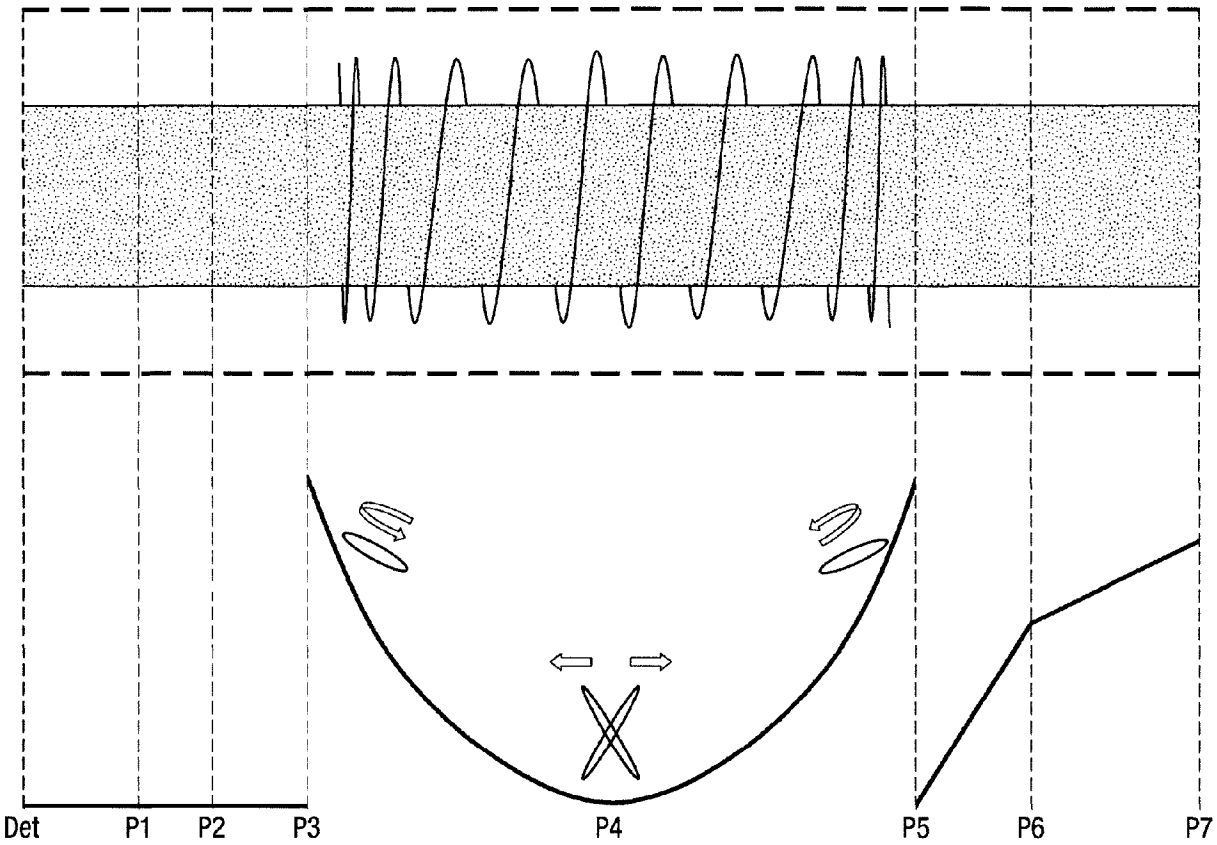
FIG. 9E shows an embodiment wherein ions oscillate within a parabolic potential and FIG. 9F shows an arrangement wherein ions are transmitted to an ion detector located at the exit of a field free region.
Figure 9F:
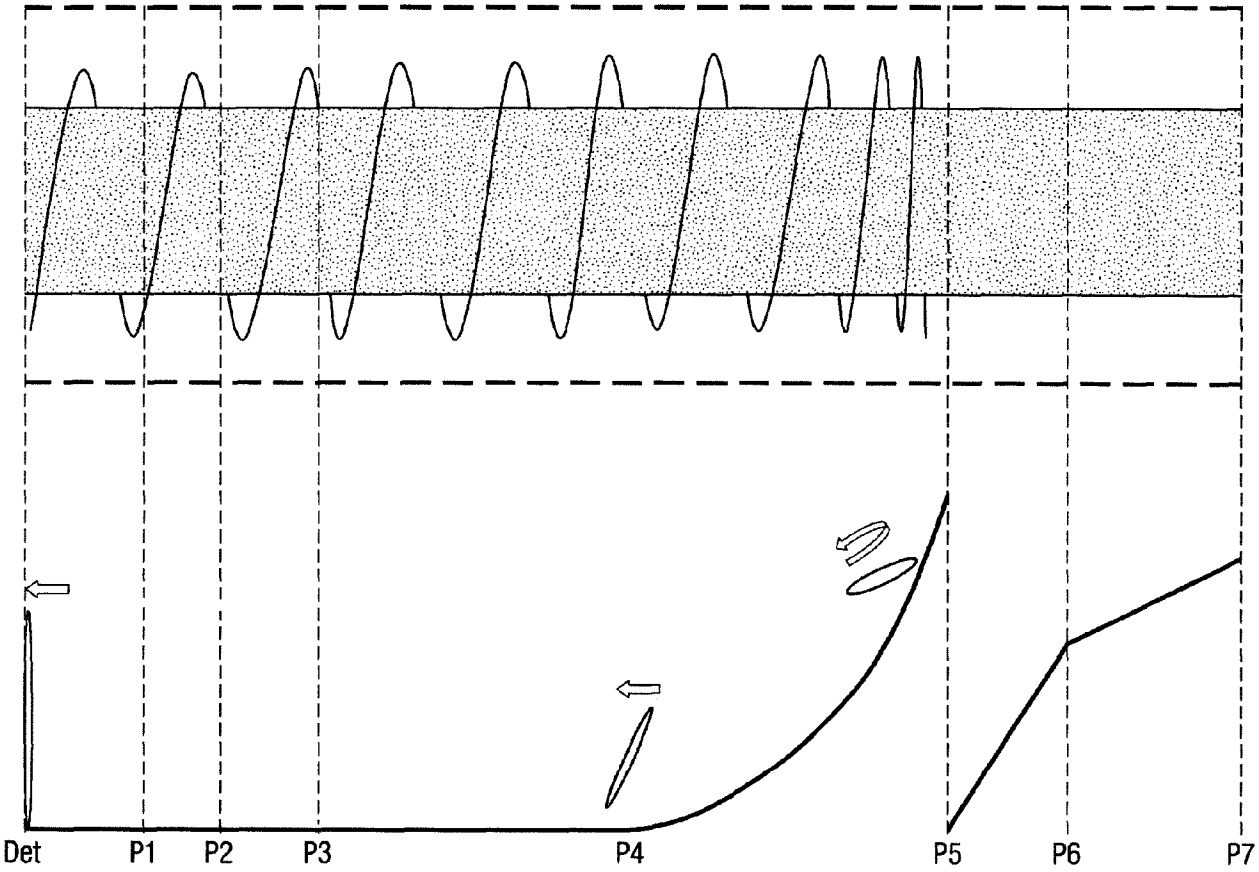

The principle of operation according to this arrangement is similar to that described above with reference to FIGS. 8A-8D, but also included is a single pass mode as shown in FIGS. 9A-9C which does not include the pulsing of the parabolic potential well. Such a mode of operation is particularly useful when faster acquisition at lower resolution is required. The higher degree of spatial focussing enables the very highest possible resolution to be achieved for the lowest number of passes of the potential well.

As will be understood by those skilled in the art, the mass range of the mass analyser will reduce with the number of round trips made of the harmonic potential well. If the analyser is traversed a number of times N then the available mass range reduces with this value in the relation:

$$m_{max}/m_{min}=(N/(N-1))^2 \quad (1)$$

This could be seen as a disadvantage but the reduced mass range may be exploited by optimising the phase space conditions of the beam entering the analyser prior to acceleration. Generally ion beams are conditioned by a combination of RF focussing elements such as lenses and grids. Optimisation of initial conditions involves confining the beam closely to the optic axis. Most often the beam is confined tightly to the optic axis by using an RF only quadrupole but this device has a strong mass dependence in its focussing action. This means that while ions of a certain mass may be effectively squeezed to the optic axis, ions of higher mass are less strongly confined and ions of lower mass may be unstable in the device or pick up excessive energy from the RF field.

Accordingly, the transmission of a limited mass range to the analyser determined by the number of round trips enables optimisation of phase space characteristics for the masses contained within the reduced mass range for best possible instrument resolution.

WO 2011/154731 (Micromass) describes how an ion beam may be expanded to optimise phase space conditions in a conventional two stage Wiley McLaren instrument. WO 2011/154731 discloses how the limiting turn around time aberration in a properly expanded beam scales with the acceleration potential difference seen by the beam rather than the electric field in that region.

Figure 10:
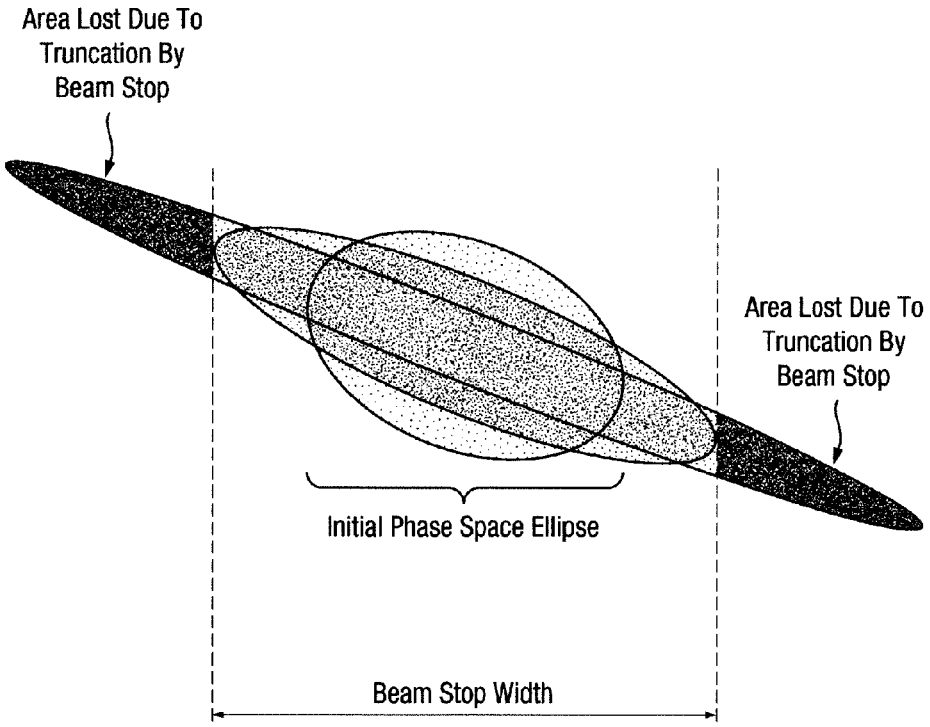
FIG. 10 shows evolution of phase space in pre push state with beam stop.

An embodiment allows for perfect aberration free beam expansion by allowing the packet of ions that have been injected into the analyser to rotate around the central electrode for as long as desired before orthogonal acceleration. The analyser is entirely field free in the axial direction before the acceleration pulse is applied. This allows free expansion due to the ions initial velocity. The process is essentially like having a variable flight distance from the transfer optics to the mass analyser. As the ions rotate and expand the phase space ellipse becomes more elongated and the beam picks up more of the acceleration potential when it is applied. So long as the analyser has a good enough spatial focussing characteristic then resolution will improve as the beam is allowed to expand. By prudent placing of an aperture plate (or beam stop) within the mass analyser acceleration region the maximum size that the beam can axially expand to may be limited to the spatial focussing characteristic of the analyser. If once the position of the beam stop is reached the ions are allowed to rotate further prior to acceleration, the phase space will take the form of a truncated ellipse getting thinner in the velocity direction the longer the rotation takes. This is illustrated in FIG. 10.

By varying the delay time greater resolutions may be reached at the expense of some ion losses. This may be thought of as analogous to the technique of delayed extraction in MALDI instruments whereby the ions are allowed to leave the target plate and adopt positions correlated with their initial velocity in the ion source prior to extraction into analyser. The correlation of ion velocity and position is very high due to the desorption event being defined by a plane. The delayed extraction according to various embodiments does not have such complete position/velocity correlation but nevertheless high degrees of ion focussing can be achieved and can be further optimised for the mass range of interest being injected into the analyser i.e. the delay time could be set to allow the central mass in the injected range to just reach the position of the beam stop (i.e. fill to the level before spatial focussing degrades the resolution) before extraction takes place.

U.S. Pat. No. 546,495 (Cornish) discloses using a curved field reflectron to bring ions of wide kinetic energy difference created by post source decay ("PSD") in MALDI Time of Flight mass analyser instruments. According to an embodiment such an arrangement may be utilised to give a first acceleration stage with good spatial focussing and the field free region necessary for suitable positioning of the ion detector.

As mentioned above, further embodiments are contemplated wherein no grid electrodes are utilised. The radial confinement afforded by the stable orbit means that the ions adopt a narrow range of radial positions. This means that it is possible to make the entire system gridless and still maintain good spatial focussing while avoiding the disturbance in the axial electric fields and ion losses that these elements introduce. Gridless mass analysers without the radial stability of the present embodiments suffer from the defocusing effect of the electric fields caused by overfilling of the ion optical elements ultimately limiting device sensitivity and resolution.

Figure 11:
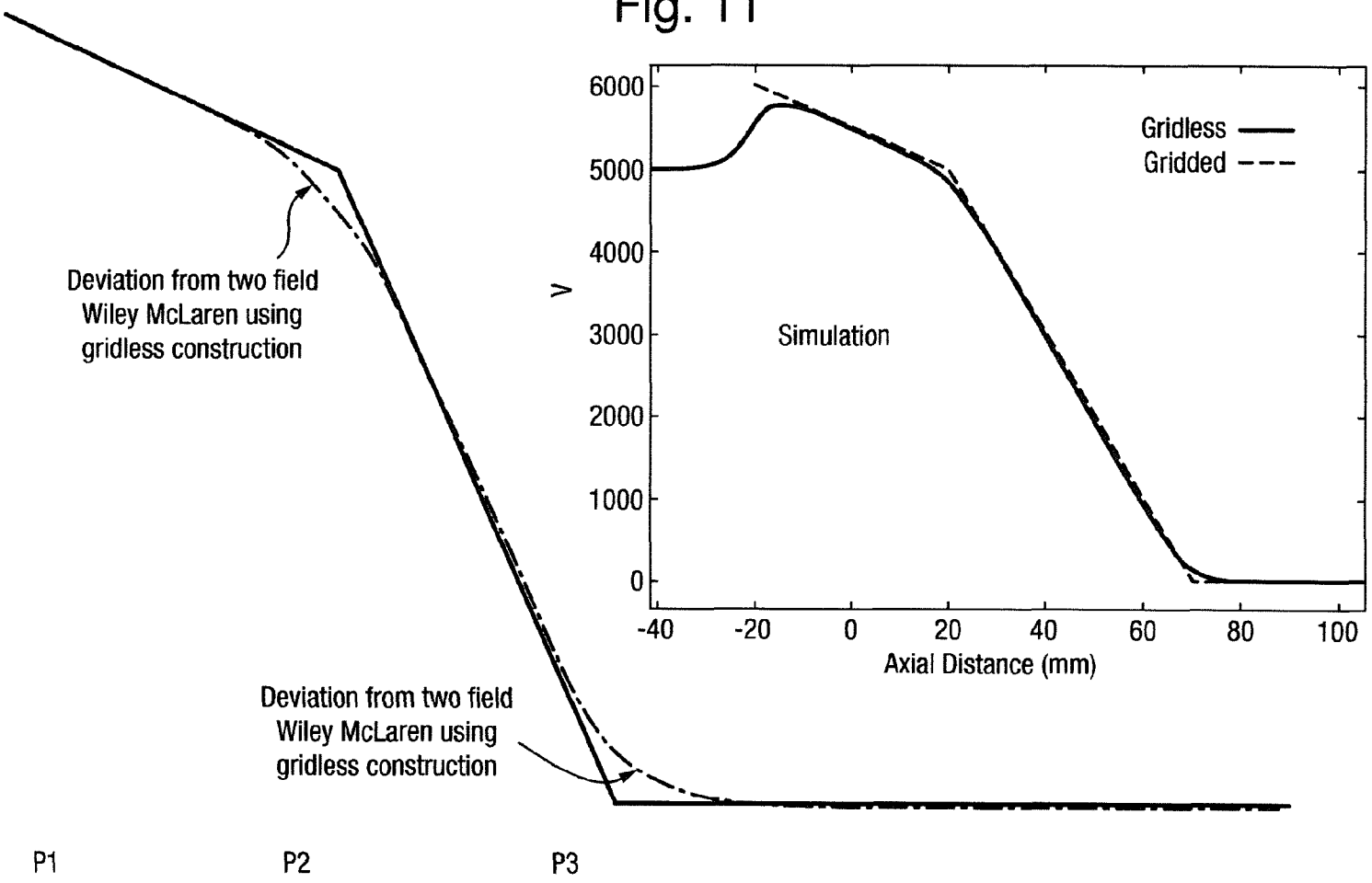
FIG. 11 shows a further embodiment comprising a gridless geometry with pulsed voltages shown as dotted lines.

An example of a gridless electrode arrangement according to an embodiment is shown in FIG. 11. In this case the electric potentials to be pulsed are shown as dotted lines but the order and nature of their pulsing and the phase space evolution is similar to that described with reference to FIGS. 8A-8D. Elimination of the grids has a further advantage in that is simplifies the method of construction as the device may consist of two concentric segmented cylinders assembled independently rather than having common mechanical parts (the grids) in contact with both outer and inner assemblies within the internal space between the two.

Modelling of a coaxial mass analyser according to an embodiment was performed. Results from an analytic system were compared with SIMION® calculated results for a coaxial mass analyser geometry according to an embodiment.

Figure 12:
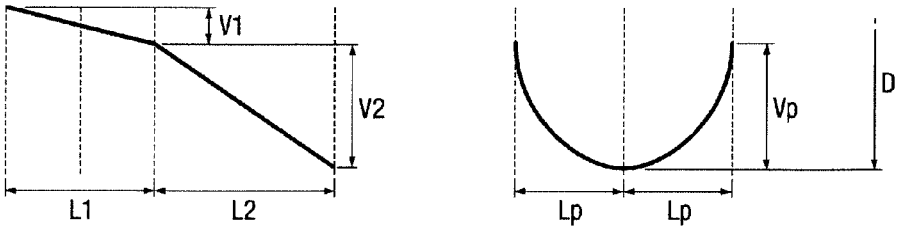
FIG. 12 shows a schematic of the geometry of a mass analyser which was modelled.

FIG. 12 shows the mass analyser geometry used for the modelling where the mean ion start plane is at the centre of the pusher region of length L1=40 mm. The voltage V1 equals 1000 V.

The acceleration region L2 was set at 50 mm and voltage V2 was set at 5000 V. The various regions are bounded by grids while the parabolic regions are not grid bounded. The distance Lp was modelled as being 99 mm and Vp was set at 10,000 V. The left hand parabola (LHP) needs to be ramped up (after ions are in the right hand parabola (RHP), and the RHP needs to be ramped down while the ions are in the LHP after the desired number of passes have occurred.

In the python model the total field free distance is a variable that can be solved while in the SIMION® simulation the ions are recorded at a fixed detector plane distance. These ions can then be imported into the python model and can be solved for a variable field free region, hence both approaches can be brought into focus.

Figure 13:
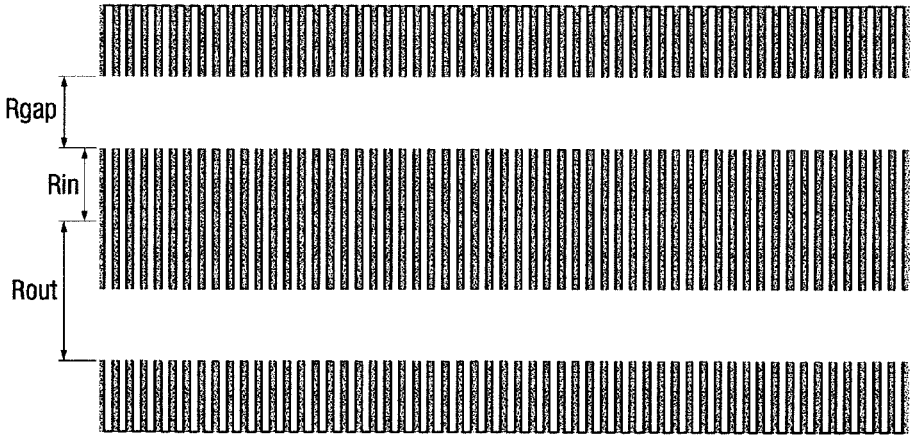
FIG. 13 shows a view of the co-axial geometry of a mass analyser which was modelled.

FIG. 13 shows the co-axial geometry used in the SIMION® modelling. The radius of the inner cylinder Rin was set at 10 mm and the outer cylinder radius Rout was set at 20 mm. Accordingly, Rgap equals 10 mm.

The axial electrode segments were 1 mm wide with 1 mm gaps therebetween. Grids were modelled as being located between segments and voltages were modelled as being applied to give linear voltage drops across the first two regions and quadratic potentials in the parabolic regions.

A potential difference was applied between the inner and the outer cylinders to give radial confinement. In the results presented +650 V was applied to the outer cylinder and the inner cylinder is at the same potential as the grids.

For singly charged ions having a mass to charge ratio of 500 with 500 eV of radial KE and +650 V being applied to the outer cylinder gives good radial confinement. Significant radial KE is required to retain confinement within the parabolic regions which give radial divergence.

Figure 14:
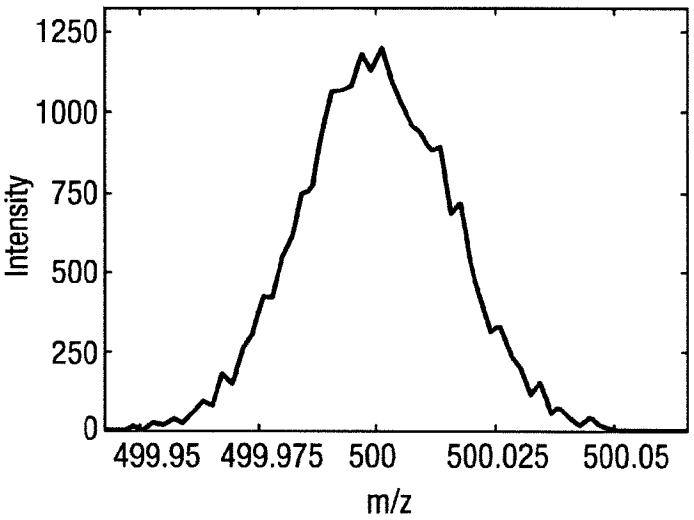
FIG. 14 shows a comparison of ion peaks due to an analytic system and a mass analyser according to an illustrative arrangement.
Figure 14:
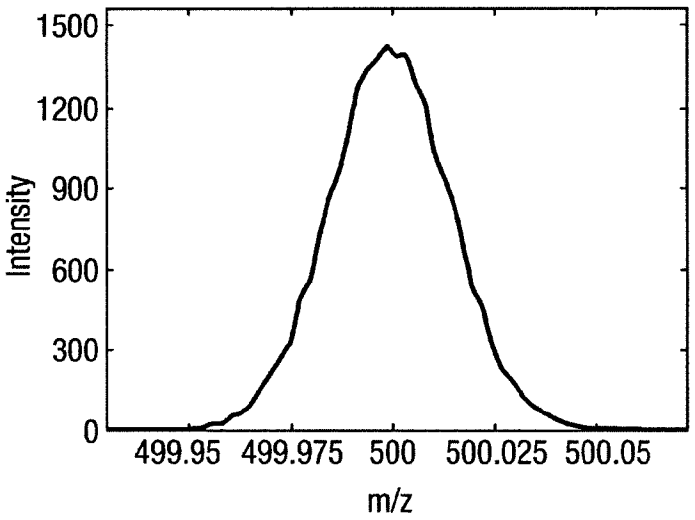

For the first system the initial ion conditions were 1 mm position delta (+/−0.5 mm), Gaussian velocity spread with a 5 m/s standard deviation, no initial ion drift, 8 passes through the parabolic regions (1 pass is into then back out of a single parabola) and 10 kV on the parabolas. The results are shown in FIG. 14.

The total FFR is 1203 mm for the analytic system with 70.712 μs drift time. For the mass analyser according to an embodiment the FFR is 1619 mm with a 79.617 μs drift time. The resolution performance of the mass analyser according to an embodiment is comparable with the analytic system.

If the initial phase space is set smaller and more passes through the parabolas are allowed then the resolution according to an embodiment is improved. For this system the initial ion conditions were 0.2 mm position delta (+/−0.1 mm), Gaussian velocity spread with a 1 m/s standard deviation, no initial ion drift, 32 passes through the parabolic regions (1 pass is into then back out of a single parabola) and 10 kV on the parabolas.

The analytic system had a FFR of 1203 mm whereas the FFR according to the preferred system was 1630 mm. The resolution of the analytic system was 189,000 compared with 170,000 resolution for system according to an embodiment.

It will be appreciated that a mass analyser having a potential resolution of 170,000 represents a very significant advance in performance compared with current state of the art commercial Time of Flight mass analysers.

Figure 15:
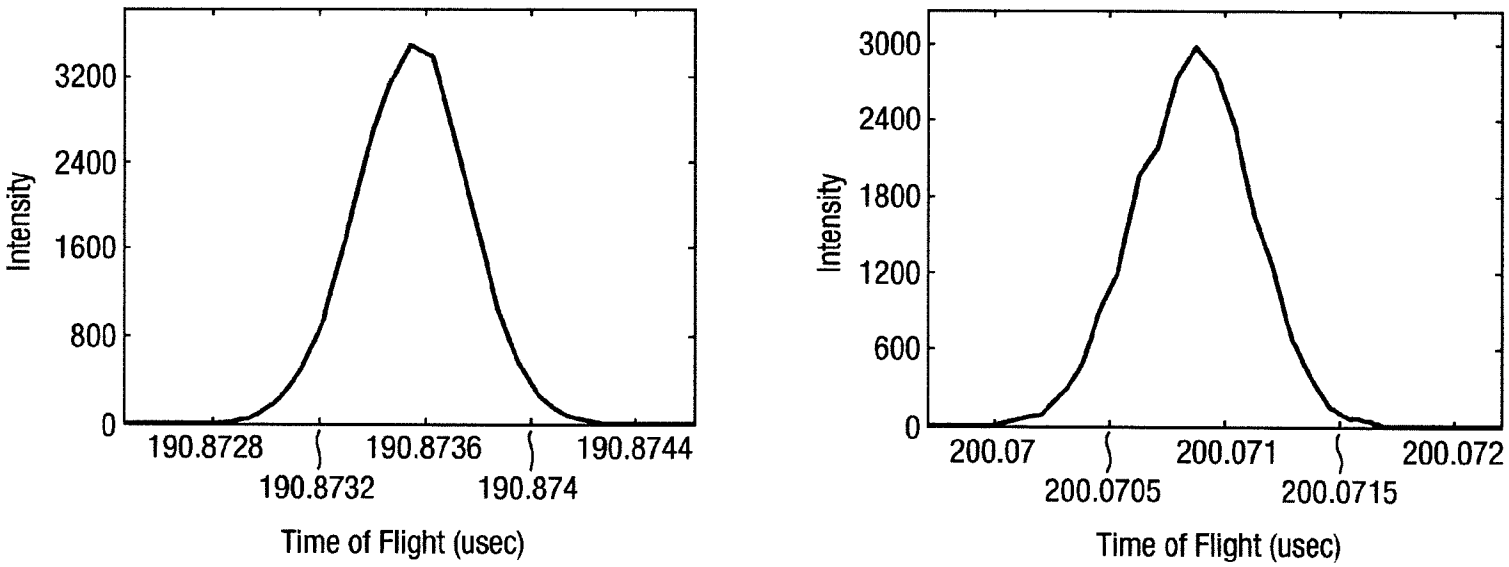
FIG. 15 shows a comparison of time of flight peaks due to an analytic system and a mass analyser according to an illustrative arrangement.

Although the analytic and SIMION® systems are not in exact agreement it is apparent that an embodiment is able to achieve about 90% of the analytic resolution. The flight time for the analytic system was 191 μs whereas the flight time for an embodiment was 200 μs as shown in FIG. 15. In both cases the flight time is not excessively long (12 GHz TDC detector).

Method of Ion Injection into Co-Axial Cylinder TOF

A less desired method of injecting ions into the spectrometer so that they achieve a stable trajectory has been shown and described above with reference to FIG. 5. According to this less desirable embodiment stable trajectories may be achieved by reducing the voltage on the inner electrode with respect to the outer electrode as the ions enter the device. This approach requires a packet of ions of limited temporal distribution to be pulsed into the device. Ions injected in this way adopt a range of radial positions that have a slight mass dependency. This is not ideal since it is required that all ions experience the same overall fields in the axial direction as they traverse the mass analyser in order to achieve the highest possible resolution.

If ions are simply injected into a pair of coaxial cylinders through a small hole without scanning the internal field then no stable trajectories are achieved and the injected ions will always describe a trajectory that ends up outside the space between the concentric cylinders. Two examples of such trajectories are shown in FIGS. 16A and 16B.

Figure 16B:
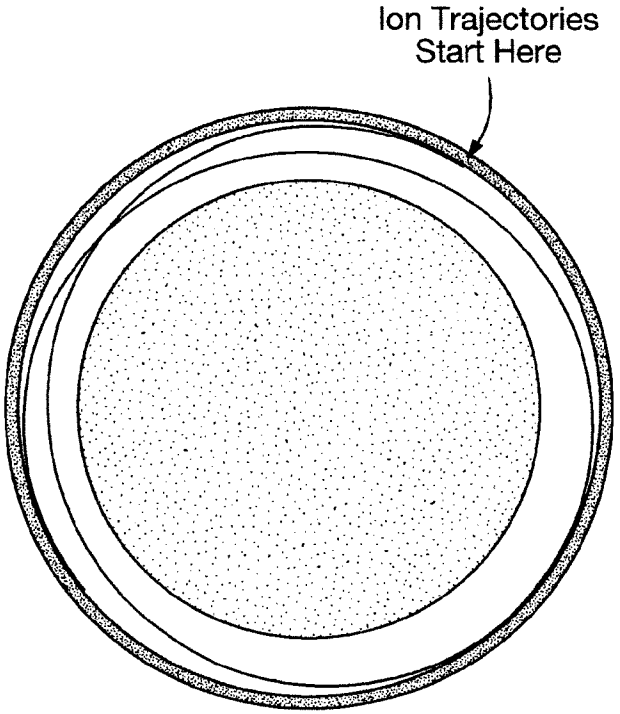
FIG. 16A shows the trajectory of an ion injected into an annular ion guiding region without scanning the internal field and FIG. 16B shows the trajectory of an ion injected into an annular ion guiding region with a higher energy and also without scanning the internal field.
Figure 16A:
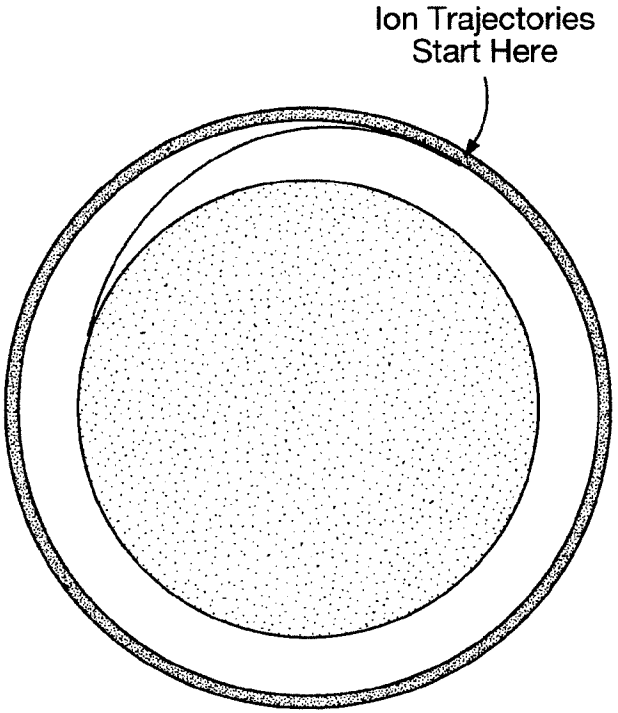

In FIG. 16A an ion is injected at an energy such that it would describe a circular trajectory halfway between the inner and outer cylinders if it were to find itself instantaneous created at such a position and with its velocity component entirely tangential to both cylinders. It can be seen that this ion is completely unstable quickly striking the inner cylinder after only about a quarter of one revolution.

In FIG. 16B the ion is injected at higher energy and is still unstable although it survives for about one and a half revolutions before it strikes the outer cylinder.

So it is desirable to find a way to inject ions into the instrument such that the fill factor is minimised and with little or no mass dependence on radial position within the device once the ions are in stable orbits.

The segmented coaxial cylinder geometry which is utilised according to an embodiment enables different voltages to be applied to different segments and different portions of such segments as required. According to an embodiment the acceleration region of the Time of Flight analyser is divided into two sectors. This allows control of the radial confining field with respect to sector angle and time. By pulsing the voltage to an angular portion of either the inner or outer cylinder the confining radial field may be pulsed ON or OFF.

Figure 17B:
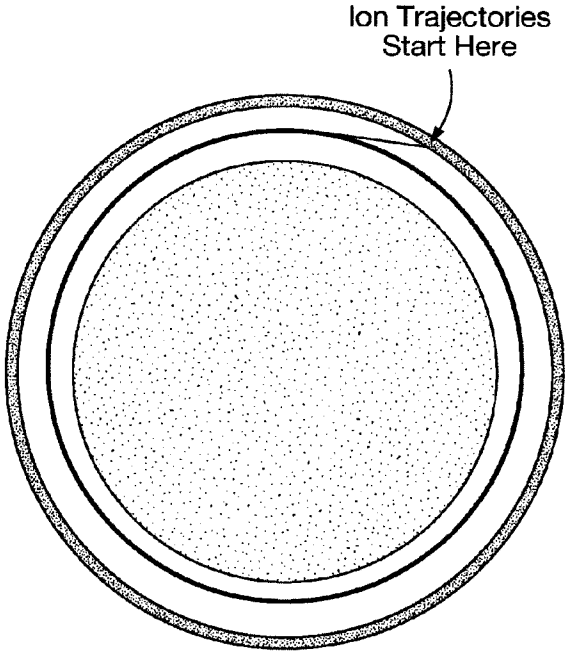
FIG. 17A shows a preferred method of injecting ions into the annular ion guiding region by splitting the injection region into a first and second sector and ensuring that ions initially experience a field free region when they are injected into the first sector and FIG. 17B shows the resulting ion trajectories after ions have moved from the first sector into the second sector and a radial field is restored in the first sector.
Figure 17A:
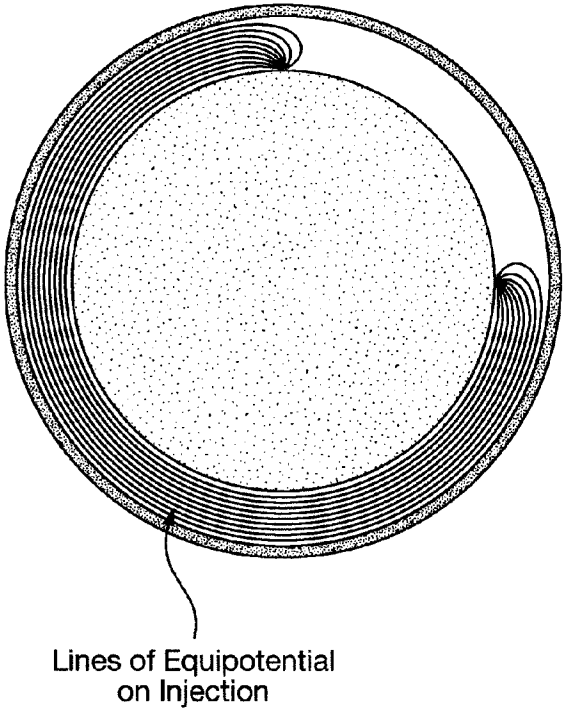

FIG. 17A shows how in an embodiment the device is split into two regions or sectors. With reference to the dials of a clock face the first region or sector (which extends from 12:00 o'clock around to 3:00 o'clock) is separated from the rest of the electrodes (which extend from 3:00 o'clock clockwise around to 12:00 o'clock).

FIG. 17A shows lines of equipotential and shows how ions that are injected at the top of the device from the right will experience a substantially field free flight in the first sector before they are deflected into the main radial sector in an anticlockwise direction. As the field is essentially static at this point mono energetic ions of differing mass take the same trajectory. This will be understood by those skilled in the art since this is a fundamental principle of electrostatics.

Whilst the ions are traversing around the main sector the small sector may be switched up to the same voltage as the main sector such that a continuous radial trapping field is created by the time the ions complete the circuit (see FIG. 17B). Such a scheme allows ion packets that are relatively long temporally to be injected into the device giving the mass analyser a high duty cycle of operation.

An embodiment is therefore particularly advantageous in that it enables ions to be injected into the instrument such that the fill factor is minimised and with effectively zero mass dependence on radial position within the device once the ions are in stable orbits.

One of the problems with known multipass Time of Flight mass analysers is that it is difficult to determine the number of passes that a particular species of ion has traversed when detected. It is known to seek to address this problem by injecting a limited mass range into the mass analyser so that such aliasing is impossible. If a shorter temporal packet of ions is injected into the analyser then it may be possible to determine the mass by retaining the angular position of the ion packet when it strikes the detector.

Figure 18B:
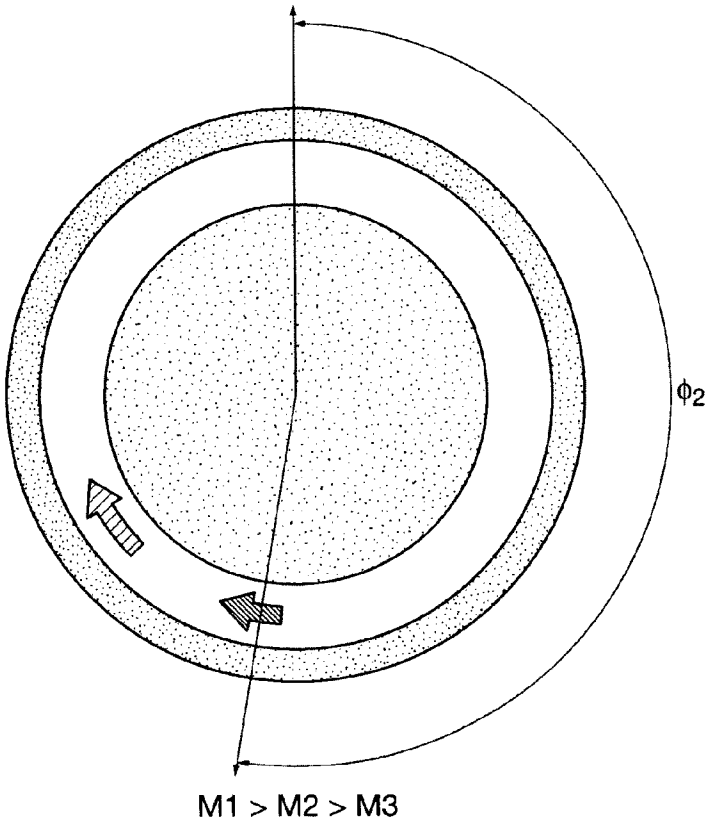
FIG. 18A shows ions which have been injected into the mass analyser separating rotationally and FIG. 18B shows ions which have been injected into the mass analyser separating rotationally at a later time.
Figure 18A:
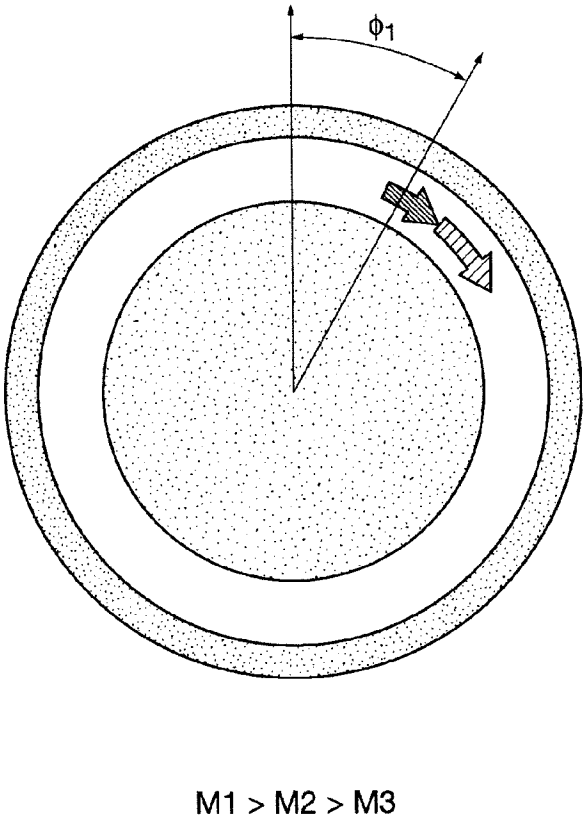

With reference to FIGS. 18A-B three ions M1, M2, and M3 (where M1>M2>M3) may be injected into the mass analyser in a compact temporal packet. Immediately after injection in FIG. 18A it can be seen that the different masses have begun to separate rotationally. With a detector that retains angular information it is possible to predict the change in angle φ as each of the ions traverse the analyser.

The combination of time of flight and angular position is enough to unequivocally determine the mass to charge (and therefore the number of roundtrips of the analyser) in certain cases. This extra angular information allows larger mass ranges to be injected into the analyser at any one time, so reducing the number of different spectra to be stitched together to cover the entire mass range.

Inductive Ion Detector

According to an embodiment an inductive detection method is used for detecting the ion beam (rather than a destructive detection method) in order to acquire a signal.

In the case of known electrostatic ion traps the lack of a true isochronous plane and the splitting of the outer electrodes of the device yields a signal which is substantially triangular in nature for each mass.

Figure 19:
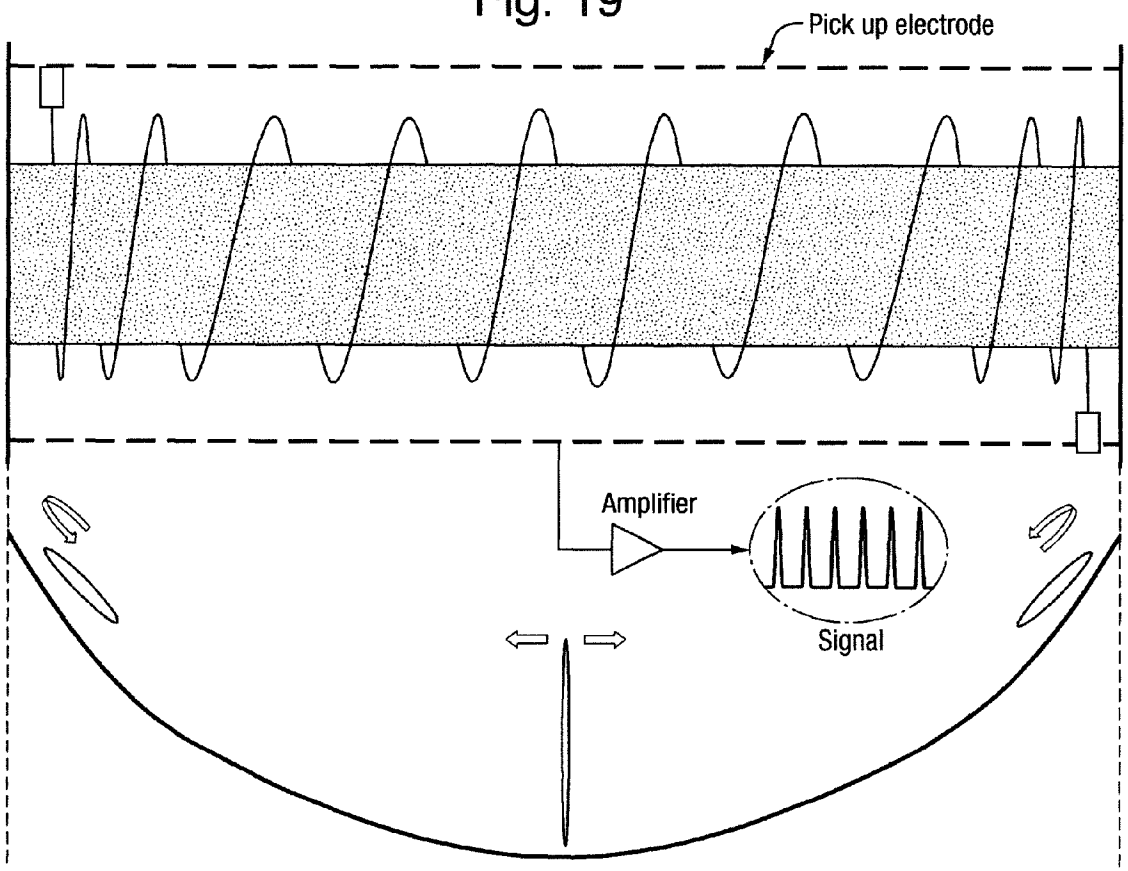
FIG. 19 shows an inductive ion detector arrangement according to an embodiment.

FIG. 19 shows an inductive ion detector according to an embodiment. Ions may be caused to oscillate axially backwards and forwards and according to one embodiment ions may undergo simple harmonic motion. The DC potential profile along the axial direction of the ion detection region may have a parabolic profile.

One or more central outer electrodes may be arranged and adapted to operate as one or more pick-up electrodes. Accordingly, one of the field defining electrodes may acts as a pick-up electrode and may be attached to an amplifier in order to amplify the signal induced in the one or more pick-up electrodes.

The pick-up electrode detects or has induced within the pick-up electrode an induced voltage as an ion beam approaches the pick-up electrode and passes the pick-up electrode. As the ion beam moves away from the pick-up electrode the induced signal is very small.

Figure 20:
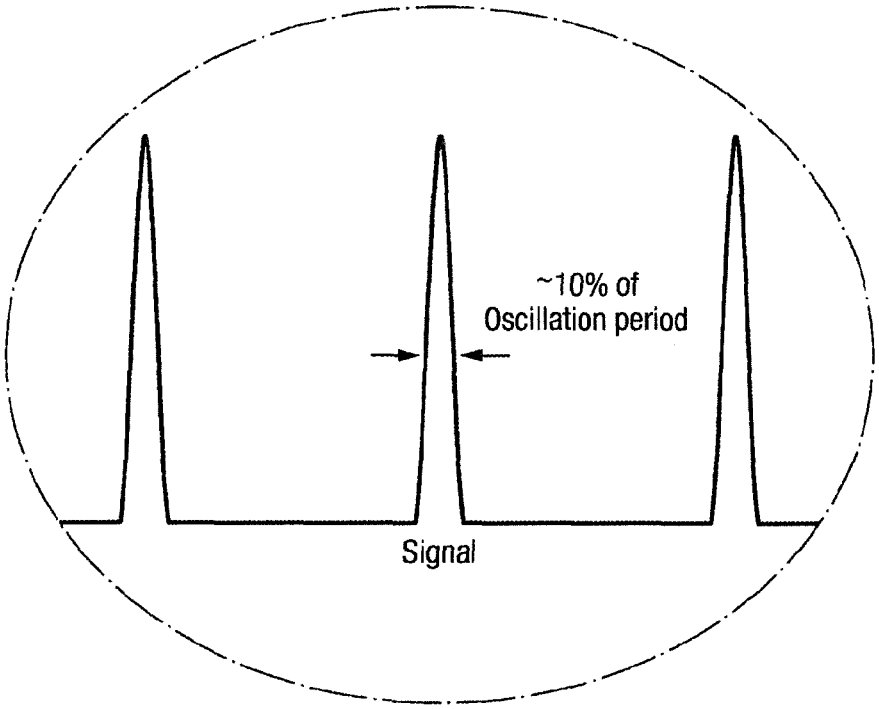
FIG. 20 shows a signal which is induced in the inductive ion detector due to the axial oscillation of ions according to an embodiment.

The induced signal quickly grows as an ion beam approaches the pick-up electrode and equally rapidly decays as the ion beam moves away from the pick-up electrode with the result that a series of pulses associated with each pass of ions past the pick-up electrode may be detected as shown in FIG. 20.

According to a further embodiment an additional pick-up electrode may be used and a differential amplifier may then be used which advantageously helps in elimination of common mode noise.

According to an embodiment a narrower central detection electrode (or electrodes) may be used that may allows advantage to be taken of the isochronous plane.

The transient signal which may be induced in the pick-up electrode(s) may be sparser but more concentrated in nature than is the case with corresponding transient signals generated with other known arrangements. The induced signal is broader than would be achieved by a destructive time of flight ion detector placed exactly at the isochronous plane due to the nature of the induced signal and also due to the fact that as the ion detection method is non-destructive then multiple measurements can be made.

Appropriate signal processing of the transients yields a resolution per unit time value that is significantly greater than that currently achieved with known electrostatic analysers. It is apparent, therefore, that the non-destructive induction or inductive ion detection method according to an embodiment is particularly advantageous compared to known arrangements. A significant improvement in resolution per unit time compared with other known arrangements is achieved since the transient signal is detected at an isochronous plane and has a higher frequency (and hence a higher information content) than a distributed signal.

The improvement in the resolution (per unit time) achievable according to an embodiment is inversely proportional to the temporal filling factor of the signal i.e. a signal occupying 10% of the oscillation period improves resolution per unit time by a factor of ten.

The mass analyser which utilises an inductive ion detector according to an embodiment therefore represents a significant advance in the field of mass spectrometry.

Although the present invention has been described with reference to preferred embodiments, it will be understood by those skilled in the art that various changes in form and detail may be made without departing from the scope of the invention as set forth in the accompanying claims.

The invention claimed is:

1. A mass analyser comprising:

an annular ion guide having a longitudinal axis and comprising a first annular ion guide section and a second annular ion guide section, wherein said annular ion guide comprises: (i) an inner cylindrical electrode arrangement which is axially segmented and comprises a plurality of first electrodes; and (ii) an outer cylindrical electrode arrangement which is axially segmented and comprises a plurality of second electrodes;

a first device arranged and adapted to introduce ions into said first annular ion guide section so that said ions form substantially stable circular orbits within said first annular ion guide section about said longitudinal axis;

a second device arranged and adapted to orthogonally accelerate ions from said substantially stable circular orbits within the first annular ion guide section into said second annular ion guide section such that ions follow substantially spiral paths as they pass through the second annular ion guide section;

a device arranged and adapted to maintain one or more parabolic DC potentials along a portion of said second annular ion guide section so that ions undergo simple harmonic motion; and an inductive ion detector arranged and adapted to detect ions within said second annular ion guide section.

2. A mass analyser as claimed in claim 1, wherein said ion detector is arranged and adapted to detect ions within said second annular ion guide section in a non-destructive manner.

3. A mass analyser as claimed in claim 1, wherein said ion detector comprises one or more cylindrical, ring or annular pick-up electrodes.

4. A mass analyser as claimed in claim 3, wherein said one or more pick-up electrodes are arranged along an outer section of said second annular ion guide section.

5. A mass analyser as claimed in claim 3, wherein said one or more pick-up electrodes are connected to an amplifier or a differential amplifier which is arranged and adapted to amplify a signal induced in said one or more pick-up electrodes.

6. A mass analyser as claimed in claim 3, wherein said one or more pick-up electrodes are arranged substantially centrally within said second annular ion guide section.

7. A mass analyser as claimed in any preceding claim, wherein said second annular ion guide section further comprises one or more second pick-up electrodes arranged along an inner section of said second annular ion guide section.

8. A mass analyser as claimed in claim 1, wherein said ions which are orthogonally accelerated are arranged to be spatially focused to an isochronous plane which is substantially perpendicular to said longitudinal axis.

9. A mass analyser as claimed in claim 1, wherein said ion detector is arranged and adapted to detect ions as said ions undergo multiple axial passes through said second annular ion guide section.

10. A mass analyser as claimed in claim 1, wherein said second device is arranged and adapted to apply a pulsed axial electric field.

11. A mass analyser as claimed in claim 10, wherein said second device is further arranged and adapted to apply a pulsed radial electric field at substantially the same time as said pulsed axial electric field.

12. A mass analyser as claimed in claim 1, wherein said second device is arranged and adapted to orthogonally accelerate said ions so that time of flight dispersion occurs only in a longitudinal direction.

13. A mass analyser as claimed in claim 12, wherein an annular time of flight ion guiding region is formed between said inner cylindrical electrode arrangement and said outer cylindrical electrode arrangement.

14. A mass analyser as claimed in claim 1, further comprising a device arranged and adapted to apply DC potentials to said inner cylindrical electrode arrangement and/or said outer cylindrical electrode arrangement in order to maintain a radial DC potential which acts to confine ions radially within said annular ion guide.

15. A mass analyser as claimed in claim 1, further comprising a control system arranged and adapted:

(i) to apply one or more first voltages to one or more of said first electrodes so that ions located in said first annular ion guide section precess or move in orbits about said inner cylindrical electrode arrangement; and then (ii) to apply one or more second voltages to one or more of said first electrodes and/or said second electrodes so that ions are orthogonally accelerated into said second annular ion guide section so that ions pass along spiral paths through said second annular ion guide section in a first axial direction;

(iii) to apply one or more third voltages to one or more of said second electrodes so that ions are reflected back in a second axial direction which is opposed to said first axial direction and wherein optionally said ions are caused to oscillate axially; and (iv) to determine the mass to charge ratio of ions passing through or oscillating axially within said second annular ion guide section.

16. A mass analyser as claimed in claim 1, wherein said second device is arranged and adapted to apply a potential difference across said first annular ion guide section so that ions are orthogonally accelerated out of said first annular ion guide section and pass into said second annular ion guide section.

17. A mass analyser as claimed in claim 1, wherein ions having different mass to charge ratios follow substantially different spiral paths through said annular ion guide or said second annular ion guide section.

18. A mass analyser as claimed in claim 1, wherein electrodes in said first annular ion guide section are segmented so that at least a first electric field sector and a second electric field sector are formed in use.

19. A mass analyser as claimed in claim 18, further comprising a control system arranged and adapted at a first time T1 to inject ions substantially tangentially into said first electric field sector whilst maintaining a substantially zero radial electric field in said first electric field sector so that said ions experience a substantially field free region whilst being injected into said first annular ion guide section; wherein said control system is further arranged and adapted to maintain a radial electric field in said second electric field sector so that at a second later time T2 ions pass from said first electric field sector into said second electric field sector and become radially confined; wherein said control system is further arranged and adapted at a third time T3, wherein T3>T1, to cause a radial electric field to be maintained in said first electric field sector so that as ions pass from said second electric field sector into said first electric field sector said ions continue to be radially confined and form substantially stable circular orbits within said first annular ion guide section; and wherein said second device is arranged and adapted to orthogonally accelerate ions from said first annular ion guide section into said second annular ion guide section at a fourth time T4, wherein T4>T3.

20. A method of mass analysing ions comprising:

providing an annular ion guide having a longitudinal axis and comprising a first annular ion guide section and a second annular ion guide section, wherein said annular ion guide comprises: (i) an inner cylindrical electrode arrangement which is axially segmented and comprises a plurality of first electrodes; and (ii) an outer cylindrical electrode arrangement which is axially segmented and comprises a plurality of second electrodes;

introducing ions into said first annular ion guide section so that said ions form substantially stable circular orbits within said first annular ion guide section about said longitudinal axis;

orthogonally accelerating ions from said substantially stable circular orbits within the first annular ion guide section into said second annular ion guide section such that ions follow substantially spiral paths as they pass through the second annular ion guide section:

maintaining one or more parabolic DC potentials along a portion of said second annular ion guide section so that ions undergo simple harmonic motion; and inductively detecting ions within said second annular ion guide section.

* * * * *